US007885568B2

(12) United States Patent
Higashi et al.

(10) Patent No.: US 7,885,568 B2
(45) Date of Patent: Feb. 8, 2011

(54) IMAGE FORMING DEVICE WITH IMPROVED FIXING TEMPERATURE CONTROL AND METHOD

(75) Inventors: Natsuyo Higashi, Toyokawa (JP); Hirotada Seki, Toyokawa (JP); Satoru Sasaki, Toyokawa (JP); Akinori Kimata, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 71 days.

(21) Appl. No.: 12/390,212

(22) Filed: Feb. 20, 2009

(65) Prior Publication Data

US 2009/0208238 A1 Aug. 20, 2009

(30) Foreign Application Priority Data

Feb. 20, 2008 (JP) ..... 2008-039157

(51) Int. Cl.
*G03G 15/20* (2006.01)

(52) U.S. Cl. ..... 399/69; 399/45

(58) Field of Classification Search ..... 399/69, 399/45

See application file for complete search history.

(56) References Cited

U.S. PATENT DOCUMENTS

2008/0260406 A1* 10/2008 Sone et al. ..... 399/69

FOREIGN PATENT DOCUMENTS

| | | |
|---|---|---|
| JP | 02-236579 | 9/1990 |
| JP | 09-068885 | 3/1997 |
| JP | 10-161468 | 6/1998 |
| JP | 10-198216 | 7/1998 |
| JP | 2002-296953 | 10/2002 |

OTHER PUBLICATIONS

Japanese Notification of Reasons for Refusal dated Nov. 24, 2009, directed towards corresponding JP Application No. 2008-039157; 13 pages.

* cited by examiner

*Primary Examiner*—Sophia S Chen
(74) *Attorney, Agent, or Firm*—Morrison & Foerster LLP

(57) ABSTRACT

An image forming device that uses only one temperature sensor to detect temperatures of the recording sheet and a rotation member for fixing, and can perform the temperature adjustment control carefully in detail during the image forming operation. The CPU 61 performs the temperature adjustment control 1 by executing the temperature adjustment program 64*b* (step S109), then executes the paper passing judgment program 64*a* to judge whether or not paper is passing (step S110). As far as it judges that no paper is passing (NO in step S110), the CPU 61 continues to perform the temperature adjustment control 1 by executing the temperature adjustment program 64*b*. When it judges that paper is passing (YES in step S110), the CPU 61 performs the temperature adjustment control (step S112).

19 Claims, 19 Drawing Sheets

FIG. 4A

T1a

| Output voltage (V) | Temperature (°C) |
|---|---|
| 1.35 | 85°C |
| 1.36 | 86°C |
| 1.37 | 87°C |
| 1.38 | 88°C |
| 1.39 | 89°C |
| 1.40 | 90°C |
| 1.41 | 91°C |
| 1.42 | 92°C |
| 1.43 | 93°C |
| 1.44 | 94°C |
| 1.45 | 95°C |
| 1.46 | 96°C |
| 1.47 | 97°C |
| 1.48 | 98°C |
| 1.49 | 99°C |

FIG. 4B

T1b

| Output voltage (V) | Temperature (°C) |
|---|---|
| 2.78 | 170°C |
| 2.79 | 171°C |
| 2.80 | 172°C |
| 2.81 | 173°C |
| 2.82 | 174°C |
| 2.83 | 175°C |
| 2.84 | 176°C |
| 2.85 | 177°C |
| 2.86 | 178°C |
| 2.87 | 179°C |
| 2.88 | 180°C |
| 2.89 | 181°C |
| 2.90 | 182°C |
| 2.91 | 183°C |
| 2.92 | 184°C |

FIG. 13

T2

| Voltage difference (V) | Paper type | Threshold temp (°C) |
|---|---|---|
| 1.30~1.39 | Thick | 100 |
| 1.40~1.49 | Thin | 95 |
| 1.50~1.59 | Regular | 90 |
| 1.60~ | OHP | 85 |

FIG. 19

T3

| Difference from threshold (°C) | -2 | -6 | -8 | . . . | -20 | -32 |
|---|---|---|---|---|---|---|
| Power (W) | 240 | 320 | 360 | . . . | 600 | 1200 |

IMAGE FORMING DEVICE WITH IMPROVED FIXING TEMPERATURE CONTROL AND METHOD

BACKGROUND OF THE INVENTION (1) Field of the Invention

The present invention relates to an image forming device for achieving image formation by transporting a recording sheet with a toner image having been transferred thereon so that the toner image is thermally fixed onto the recording sheet, and to an image forming method for use in the image forming device.

(2) Description of the Related Art

There has been proposed a technology in which an image forming device is provided with a sensor that detects a temperature of a fixing roller for a temperature adjustment control during a warm-up such that the image forming device can start executing the image forming operation, the sensor also detects a temperature of the recording sheet after the fixing, and it is determined whether an error has occurred, based on the temperatures of the fixing roller and the recording sheet detected by the sensor (Patent Document 1: Japanese Patent Application Publication No. 10-161468). More specifically, when there is an extreme difference between the detected temperatures of the fixing roller and the recording sheet, it is determined that an error has occurred.

There has also been proposed a technology in which an image forming device is provided with a temperature sensor at a position more downstream in a recording sheet transport direction than a fixing nip, which is formed between a fixing roller and a pressurizing roller, where the temperature sensor detects the temperature of the fixing roller facing the temperature sensor with a recording sheet transport route running therebetween (Patent Document 2: Japanese Patent Application Publication No. 10-198216). When the recording sheet passes between the fixing roller and the temperature sensor, the measuring area of the temperature sensor is blocked by the recording sheet, and the temperature sensor detects the temperature of the recording sheet. This makes it possible to determine whether or not a fixing error occurred, based on the detected temperature of the recording sheet.

Meanwhile, it is desired that the image forming device has simplified wiring and less number of constituent parts.

Also, for the sake of user's convenience, the image forming device needs to be heated rapidly when it is powered on. This may be accomplished by reducing the thermal capacity of the fixing roller. However, when the thermal capacity of the fixing roller is reduced, the temperature thereof is easy to change. In that case, to stably fix the image onto the recording sheet, the temperature adjustment needs to be controlled more carefully than conventionally.

The technology of the Patent Document 2 contributes to the reduction in the number of constituent parts and simplified wiring because with this technology, only one temperature sensor is used to detect the temperatures of the fixing roller and the recording sheet. The Patent Document 2, however, does not have any recitation concerning the temperature adjustment control of the fixing roller.

Suppose here that the temperature adjustment control performed during the warm-up as disclosed in the Patent Document 1 is applied to the technology of the Patent Document 2. Then, it would be possible to perform the temperature adjustment control during the warm-up, based on the temperature of the fixing roller.

Such an image forming device would be able to detect the temperature of the fixing roller while a recording sheet is not passing between the fixing roller and the temperature sensor during the image forming operation, but would not be able to detect the temperature of the fixing roller while a recording sheet is passing. In such an image forming device, the temperature adjustment control would be available during the warm-up, but a careful and detailed temperature adjustment control would not be available.

SUMMARY OF THE INVENTION

An object of the present invention is therefore to provide an image forming device that uses only one temperature sensor to detect temperatures of the recording sheet and a rotation member for fixing, and can perform the temperature adjustment control carefully in detail during the image forming operation.

The above-mentioned object is fulfilled by one aspect of the present invention, namely an image forming device for achieving image formation by transporting a recording sheet with an unfixed image formed thereon to pass a fixing nip so that thereby the unfixed image is thermally fixed onto the recording sheet, the fixing nip being formed between two rotation members located closely to each other as a pair, at least one of the two rotation members having been heated by a heater, the image forming device comprising: a temperature sensor located at a position more downstream than the fixing nip in a recording sheet transport direction, and operable to detect a surface temperature of one of the rotation members which is located across a recording sheet transport route from the temperature sensor; a judging part operable to judge whether or not the recording sheet after the fixing is passing between the temperature sensor and the one of the rotation members; and a controller operable to control the heater using a first threshold value and a temperature detected by the temperature sensor when the judging part has judged that the recording sheet is not passing, and to control the heater using a second threshold value, which is different from the first threshold value, and the temperature detected by the temperature sensor when the judging part has judged that the recording sheet is passing.

The above-mentioned object is also fulfilled by another aspect of the present invention, namely an image forming method for use in an image forming device for achieving image formation by transporting a recording sheet with an unfixed image formed thereon to pass a fixing nip so that thereby the unfixed image is thermally fixed onto the recording sheet, the fixing nip being formed between two rotation members located closely to each other as a pair, at least one of the two rotation members having been heated by a heater, the image forming device including a temperature sensor that is located at a position more downstream than the fixing nip in a recording sheet transport direction, and is operable to detect a surface temperature of one of the rotation members which is located across a recording sheet transport route from the temperature sensor, the image forming method comprising the steps of: judging whether or not the recording sheet after the fixing is passing between the temperature sensor and the one of the rotation members; and controlling the heater using a first threshold value and a temperature detected by the temperature sensor when the judging step has judged that the recording sheet is not passing, and controlling the heater using a second threshold value, which is different from the first threshold value, and the temperature detected by the temperature sensor when the judging step has judged that the recording sheet is passing.

Note that the recording sheet is a medium on which an image is formed by the image forming device, and is a medium in the shape of a sheet, such as a sheet of paper or a sheet for OHP (Over-Head Projector).

With the above-stated structure, the image forming device of the present invention includes one temperature sensor that can detect the temperatures of both the recording sheet and one of rotation members, performs the temperature adjustment control based on the first threshold value and temperature of the rotation member when the temperature sensor is detecting the temperature of the rotation member; and performs the temperature adjustment control based on the second threshold value and temperature of the recording sheet when the temperature sensor is detecting the temperature of the recording sheet. Therefore, the first threshold value may be set to a standard temperature at which an excellent fixing can be obtained, based on the temperature of the rotation member preliminarily, and the second threshold value may be set to a standard temperature at which an excellent fixing can be obtained, based on the temperature of the recording sheet preliminarily. This enables the image forming device to perform the temperature adjustment control carefully in detail during the image forming operation such that it can obtain an excellent fixing regardless of whether the temperature sensor is detecting the temperature of the recording sheet or the temperature of one rotation member.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIGS. 4A and 4B show the tables T1*a* and T1*b;*

FIG. 12 is a flowchart showing the operation of the image forming device 1;

FIG. 13 shows the table T2;

FIG. 19 shows a table used for controlling the heating by an IH heater.

DESCRIPTION OF THE PREFERRED EMBODIMENT

The following describes preferred embodiments of the present invention with reference to the attached drawings.

Embodiment 1

First, an image forming device 1 of Embodiment 1 will be described.

1. Structure 1-1 Basic Structure

Figure 1:
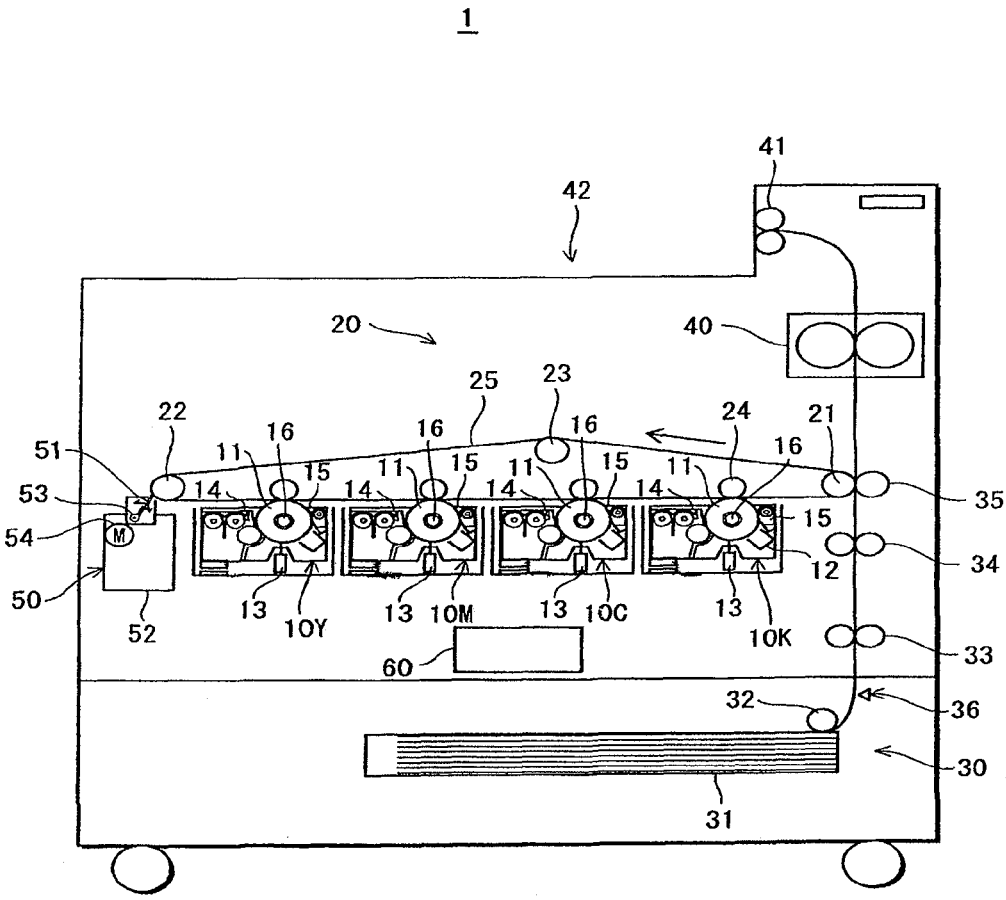
FIG. 1 shows a schematic structure of the image forming device 1 in Embodiment 1.

The following describes the structure of the image forming device 1 that is a tandem-type full-color copier, with reference to FIG. 1.

As shown in FIG. 1, the image forming device 1 includes an image forming unit 20, a paper-feed unit 30, a fixing unit 40, and a control unit 60, where the image forming unit 20 includes an intermediate transfer belt 25 and image creating units 10C, 10M, 10Y, and 10K corresponding respectively to colors of cyan (C), magenta (M), yellow (Y), and key tone (K).

The image forming device 1 is connected with a network such as a LAN (Local Area Network), and upon receiving an instruction to execute a print job from an external terminal device (not illustrated) or an operation unit (not illustrated), the image forming device 1 executes the print job according to the received instruction.

The image creating units 10C, 10M, 10Y, and 10K are arranged in series with an intermediate interval therebetween, facing and along the intermediate transfer belt 25, in the order of 10Y, 10M, 10C, and 10K from the upstream side to the downstream side in the image forming process.

The image creating unit 10K includes a photosensitive drum 11 as an image carrier, and also includes a charger 12, an image exposing device 13, a developer 14, and a cleaner 15 that are positioned around the photosensitive drum 11. The position of the image creating unit 10K is determined based on an axis 16 of the photosensitive drum 11 relative to a chassis of the image forming device.

The structure of the other image creating units 10Y, 10M and 10C is the same as that of the image creating unit 10K, and detailed description thereof is omitted here.

The image forming unit 20 includes a drive roller 21, a passive roller 22, a tension roller 23, a first transfer roller 24 opposite to the photosensitive drum 11, and the intermediate transfer belt 25, as a transfer body, that is suspended with a tension between the three rollers 21, 22, and 23.

The paper-feed unit 30 includes a paper-feed cassette 31 for holding paper, a paper-feed roller 32 for feeding out the paper one sheet by one sheet from the paper-feed cassette 31, a pair of transport rollers 33 for transporting the fed-out paper, a pair of timing rollers 34 for adjusting the timing of feeding out the paper to a second transfer position, and a second transfer roller 35. Also provided is a paper-feed sensor 36 that is a sensor for detecting the paper fed out by the paper-feed roller 32.

The control unit 60, upon receiving an instruction to form an image based on an image signal, generates a digital image signal by converting the image signal into the colors of C, M, Y, and K, and generates a drive signal for driving the image exposing device 13. Upon receiving the drive signal from the control unit 60, the exposing device 13 in each of the image creating units 10Y, 10M, 10C, and 10K emits a laser beam and performs an exposure scan onto the surface of the photosensitive drum 11 in each image creating unit in the main scanning direction.

Before the photosensitive drum 11 is subjected to the exposure scan, the residual toner is removed from the surface of the photosensitive drum 11 by the cleaner 15, electricity is removed therefrom by radiation of an eraser lamp (not illustrated), and the surface is evenly charged by the charger 12. Accordingly, the photosensitive drum 11 is subjected to the exposure scan by the laser beam in the evenly-charged state. With this procedure, an electrostatic latent image of the image having been instructed to be formed is formed on the surface of the photosensitive drum 11.

Each of the formed electrostatic latent images is developed by the developer 14 for each color, and thereby a toner image is created on the surface of the photosensitive drum 11 as an image formed by the developer for each color of C, M, Y, and K. The toner image is transferred onto the rotating intermediate transfer belt 25 at each first transfer position by the electrostatic attraction that is generated by the voltage that is applied to the first transfer roller 24 provided on the back surface side of the intermediate transfer belt 25.

In this first transfer, the toner images of each color are transferred at shifted timings so that they are layered on the intermediate transfer belt 25 at the same position, where the timing is shifted from the upstream side to the downstream side in the image forming process. In the first transfer, the toner images of each color are layered in the order of, from bottom, Y, M, C, and K onto the surface of the intermediate transfer belt 25. The toner images of each color layered on the intermediate transfer belt 25 are transported to a second transfer position as the intermediate transfer belt 25 is moved forward.

Meanwhile, a sheet of paper has been fed from the paper-feed unit 30 and the transportation timing is adjusted by the pair of timing rollers 34 so that the paper reaches the second transfer position at the same timing as the toner images layered on the intermediate transfer belt 25. And at the second transfer position where the second transfer roller 35 rotates, the toner images are transferred from the intermediate transfer belt 25 onto the sheet of paper by the electrostatic attraction that is generated by the voltage applied to the second transfer roller 35 when the paper passes between the second transfer roller 35 and the intermediate transfer belt 25.

The toner images of each color are layered in the order of, from bottom, Y, M, C, and K onto the surface of the intermediate transfer belt 25. Accordingly, after the transfer onto the paper surface, the toner images of each color are layered in the order of, from bottom, K, C, M, and Y on the surface of the paper. With this arrangement of forming the toner image of color K as the lowest layer on the surface of the paper, the color reproducibility is improved.

After passing the second transfer position, the paper is transported to the fixing unit 40. The fixing unit 40 applies heat and pressure to the toner images so that the images are fixed onto the paper. The paper after this process is transported further from the fixing unit 40 and then is ejected onto an outlet tray 42 by a pair of ejection rollers 41.

The image forming device 1 is further provided with a cleaner 50. The cleaner 50 includes a blade 51 and a housing 52, where the blade 51 is structured to scrape off the residual toner from the surface of the intermediate transfer belt 25, and the housing 52 houses the scraped-off toner.

An axis 53 of the blade 51 is connected with a rotation axis of a switch motor 54 via a power transmission mechanism which is composed of a gear (not illustrated) and the like. The switch motor 54 is connected with the control unit 60. The control unit 60 switches the blade 51 between the position connected with the intermediate transfer belt 25 and the position separated from the intermediate transfer belt 25, by driving the switch motor 54 to rotate to move the blade 51 in the direction indicated by the arrow.

As described above, the image forming device 1 forms an image on the paper by performing the processes of charge, exposure, development, transfer, fixture, cleaning, and electricity removal.

1-2. Structure of Fixing Unit 40

Figure 2:
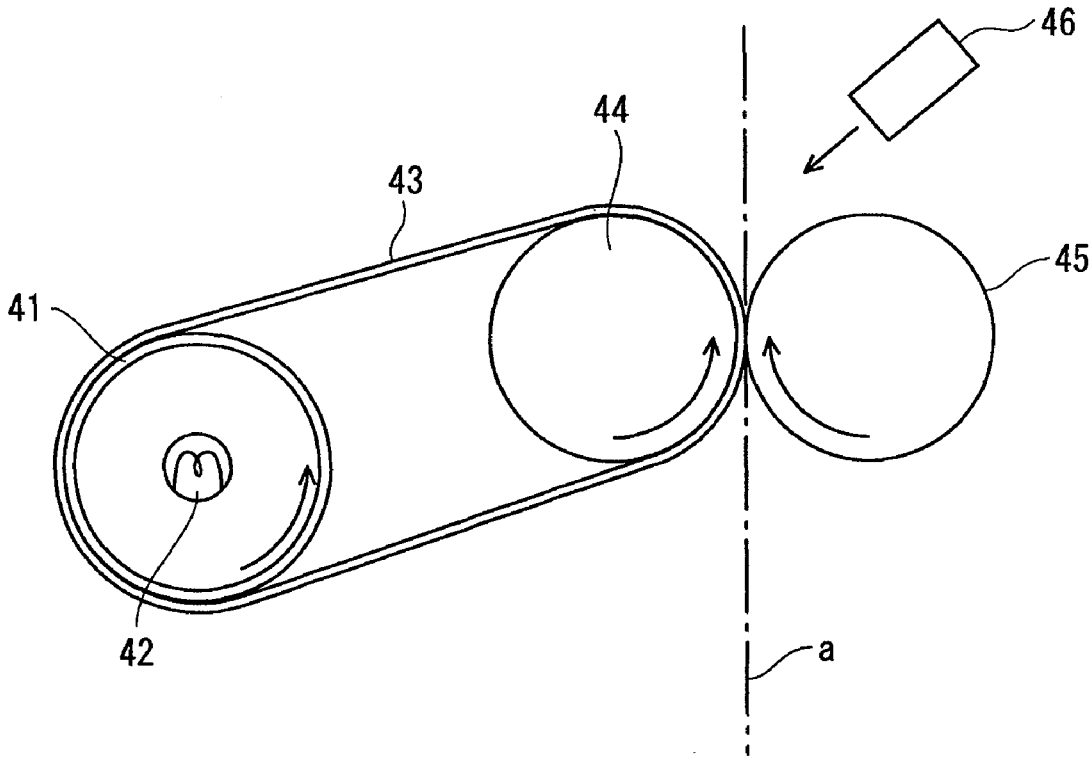
FIG. 2 is a cross sectional view showing a schematic structure of the fixing unit 40.

The following describes the structure of the fixing unit 40 with reference to FIG. 2.

As shown in FIG. 2, the fixing unit 40 includes a heating roller 41, a heater 42, a fixing belt 43, a fixing roller 44, a pressurizing roller 45, and a thermopile 46, where the fixing belt 43 is wound around the heating roller 41 and the fixing roller 44, the pressurizing roller 45 is arranged close to the fixing roller 44, and a fixing nip is formed at a position where the fixing belt 43 and the pressurizing roller 45 contact each other.

The heater 42 is provided in the interior of the heating roller 41 such that the heater 42 heats the heating roller 41, the heat is conducted from the heating roller 41 to the fixing belt 43, and the fixing belt 43 is heated. The heater 42 may be achieved by a halogen lamp, an IH heater or the like.

The fixing unit 40 includes the thermopile 46 as a non-contact infrared sensor.

The heating roller 41 is structured as a steel cylinder or an aluminum pipe on whose surface a release layer is formed, where the release layer is made of fluorine resin or the like. The heating roller 41 conveys the heat given from the heater 42, to the fixing belt 43, and drives the fixing belt 43 to rotate at a speed that is in agreement with the speed at which the paper passes while the fixing belt 43 is tensioned by the heating roller 41 and the fixing roller 44.

The fixing roller 44 is structured as a steel cylinder or an aluminum pipe on whose surface an elastic layer and a release layer are formed, where the elastic layer is made of silicon rubber or the like, and the release layer is made of fluorine resin or the like.

The fixing belt 43 is an elastic no-end belt structured from a cylindrical heat resistance layer on whose surface a release layer is formed, where the heat resistance layer is made of polyimide resin or the like, the release layer is made of fluorine resin or the like.

The pressurizing roller 45 is structured as a steel cylinder or an aluminum pipe on whose surface a release layer is formed, where the release layer is made of fluorine resin or the like.

The thermopile 46 is a temperature sensor having a function to detect a temperature of an object that emits heat, and output a voltage according to the detected temperature. The thermopile 46 is connected with the control unit 60. The thermopile 46 is provided at a position where it is across a paper transport route "a" (represented by the dashed line in FIG. 2), from the fixing belt 43 so that it can detect the temperature of the fixing belt 43 at a position more downstream than the fixing nip in the paper transfer direction. The measuring area of the thermopile 46 is indicated by the arrow in the drawing.

With the above-described structure, the thermopile 46 detects the temperature of the fixing belt 43 when no paper is passing between the fixing belt 43 and the thermopile 46, and the temperature of the paper when the paper is passing between the fixing belt 43 and the thermopile 46. The response time of the thermopile 46 is fast. It is presumed here that the response time of the thermopile 46 is 30 ms.

Hereinafter, the time period in which the thermopile 46 detects the temperature of the paper while the paper is passing between the fixing belt 43 and the thermopile 46 is referred to as "paper passing time", and the time period in which the thermopile 46 detects the temperature of the fixing belt 43 while no paper is passing between the fixing belt 43 and the thermopile 46 is referred to as "no-paper passing time".

1-3. Internal Structure

Figure 3:
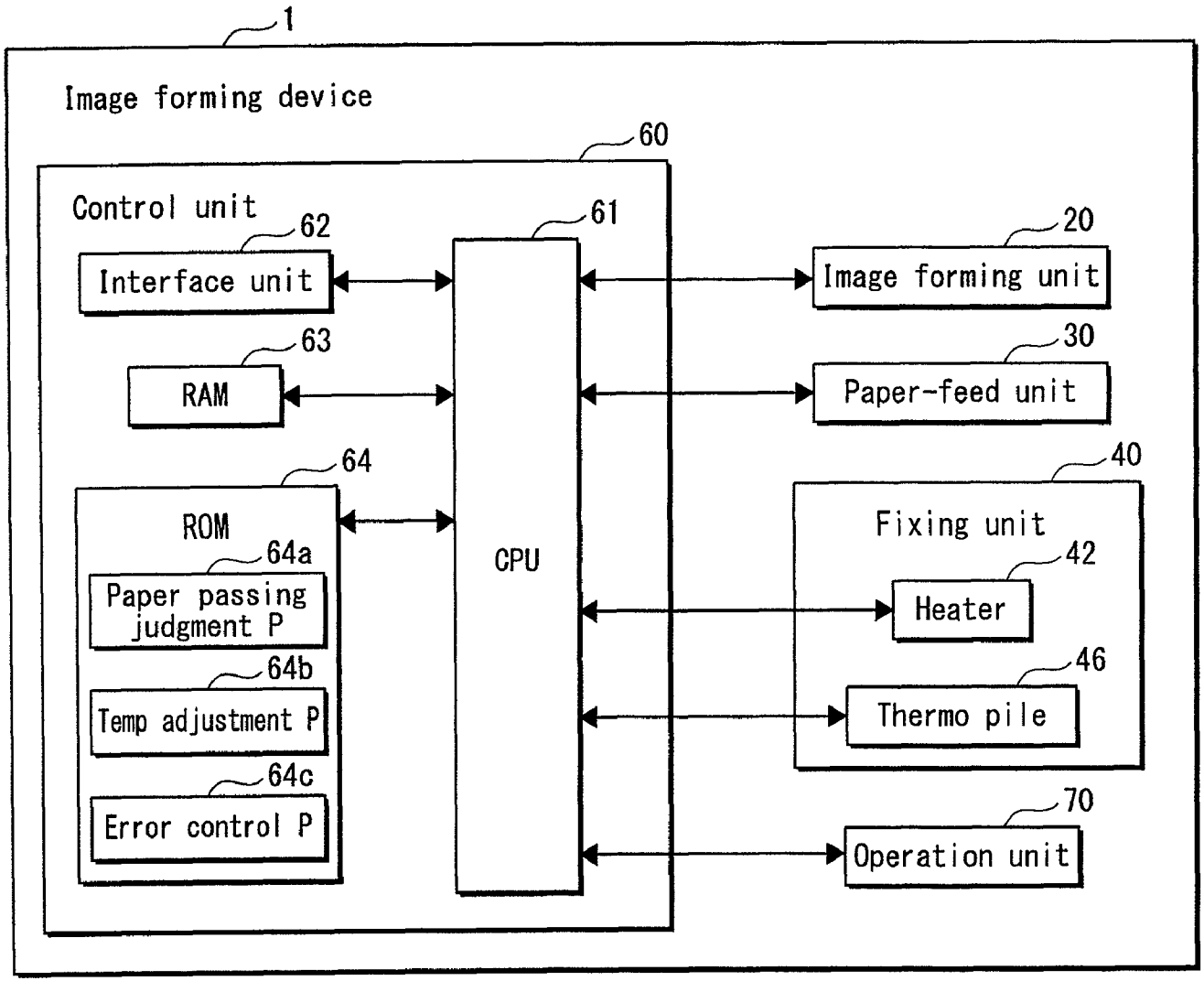
FIG. 3 is a block diagram showing the internal structure of the image forming device 1.

The following describes the internal structure of the image forming device 1, and its relationship with the control unit 60 and other devices with reference to FIG. 3.

As shown in FIG. 3, in the interior of the image forming device 1, the control unit 60 is connected with the image forming unit 20, the paper-feed unit 30, the fixing unit 40, and an operation unit 70.

The control unit 60 includes a CPU (Central Processing Unit) 61, an interface unit 62, a RAM (Random Access Memory) 63, and a ROM (Read Only Memory) 64.

The CPU 61 performs each process by reading out a program from the thermopile 46 and executing the read-out program.

The interface unit 62 is a device for connecting the CPU 61 with a network such as a LAN. More specifically, the interface unit 62 is achieved by a LAN card or a LAN board. The interface unit 62 receives a print job transmitted from outside the device, and sends the received print job to the CPU 61.

The RAM 63 stores data or the like that is required when the CPU 61 executes a program. Especially, the RAM 63 stores tables T1*a* and T1*b* (which will be described later) that show the relationships between the temperature and the output voltage of the thermopile 46. The RAM 63 converts an output voltage of the thermopile 46 into a temperature by referring to the tables T1*a* and T1*b*.

The ROM 64 stores programs that are executed by the CPU 61 to control the image forming device 1. Especially, the ROM 64 stores a paper passing judgment program (paper passing judgment P) 64*a*, a temperature adjustment program (temperature adjustment P) 64*b*, and an error control program (error control P) 64*c*.

The paper passing judgment program 64*a* has a function to judge whether or not paper is passing between the fixing belt 43 and the thermopile 46, based on the change in the output voltage value of the thermopile 46, namely, a function to judge whether it is the paper passing time or the no-paper passing time.

The temperature adjustment program 64*b* has a function to control ON/OFF of the heater 42 based on the result of comparison between (a) 180° C. or 95° C. as predetermined threshold value and (b) a temperature obtained by referring to the tables T1*a* and T1*b*.

The error control program 64*c* has a function to compare a temperature corresponding to a voltage value output from the thermopile 46 after the paper passing judgment program 64*a* judges that it is the no-paper passing time, with a temperature corresponding to a voltage value output from the thermopile 46 after the paper passing judgment program 64*a* judges that it is the paper passing time, judge, based on the comparison result, whether or not the thermopile 46 is abnormal, and when it judges that the thermopile 46 is abnormal, determines that an error has occurred.

The operation unit 70 receives an operation input by the user, and transmits a signal to the CPU 61, depending on the received operation. The operations that may be received by the operation unit 70 include, for example, an instruction for executing a print job.

2. Tables T1*a*, T1*b*

Next, the tables T1*a* and T1*b* will be described with reference to FIGS. 4A and 4B. The tables T1*a* and T1*b* are used to convert output voltages of the thermopile 46 into temperatures.

The thermopile 46 outputs a voltage in accordance with an infrared ray emitted by a heat radiator. The radiation rates of infrared rays vary depending on the material of the heat radiator or the like. Thus, the relationships between the voltage value and temperature vary depending on heat radiator. That is to say, when a heat radiator A and a heat radiator B have the same temperature but different radiation rates, the thermopile 46 outputs different voltage values for them. For this reason, to achieve a highly accurate measurement, it is preferable that a conversion table is set for each of the radiation rates of possible measurement targets, where the conversion table shows correspondence between output voltage values of the thermopile 46 and temperatures.

Accordingly, in the present embodiment, the tables T1*a* and T1*b* are stored in the RAM 63, as conversion tables having been set for the radiation rates of the fixing belt 43 and the paper that are the measurement targets, respectively. The temperature adjustment program 64*b* and the error control program 64*c* converts output voltages of the thermopile 46 into temperatures by referring to the table T1*a* or table T1*b*.

The table T1*a* is a table used to convert voltage values into temperatures while the thermopile 46 detects the temperature of the paper (paper passing time). In the present example of the table, the conversion values start with 85° C., providing allowance around the expected temperature (95° C.).

The table T1*b* is a table used to convert voltage values into temperatures while the thermopile 46 detects the temperature of the fixing belt 43 (no-paper passing time). In the present example of the table, the conversion values start with 170° C., providing allowance around the expected temperature (180° C.).

The values to be set in the tables T1*a* and T1*b* may be determined based on an operational experiment performed beforehand.

3. Judgment on Paper Passing and Temperature Adjustment Control

Figure 5:
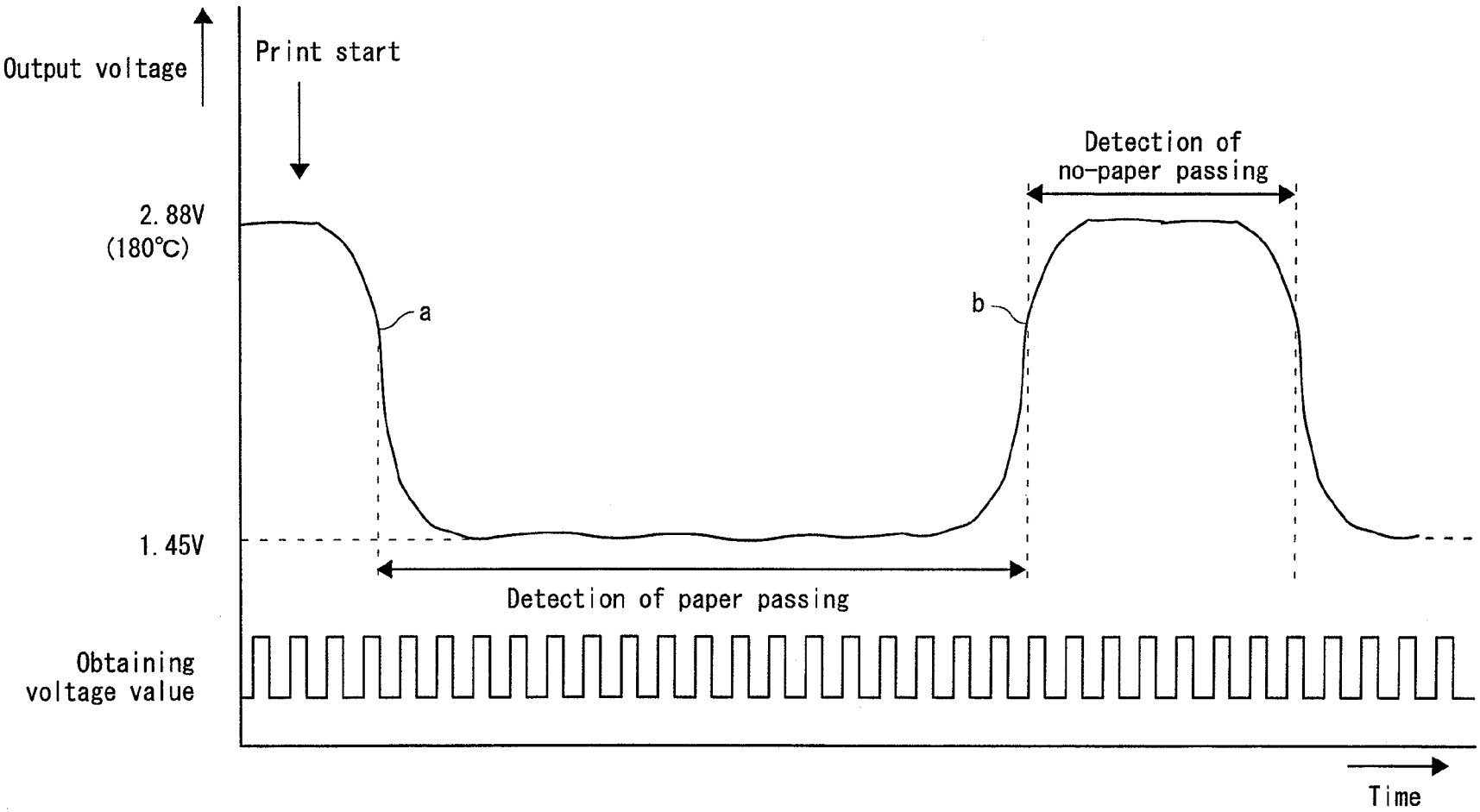
FIG. 5 shows the change in the output voltage of the thermopile 46.

Next, the judgment made by the paper passing judgment program 64*a* and the control performed by the temperature adjustment program 64*b* will be described with reference to the change in the output voltage of the thermopile 46 shown in FIG. 5.

3-1 Judgment on Paper Passing

Before any printing operation is started, the image forming device 1 is warmed up so that the fixing belt 43 heated to 180° C. This specific value of temperature is set as the temperature of the fixing belt 43 at which an optimum fixing state should be obtained, and the specific value is determined based on the measurement results of an experiment, and is stored in the RAM 63. Hereinafter, the temperature value of the fixing belt 43 explained above is referred to as the first threshold value.

After the warm-up, until a print is started, the fixing belt 43 is kept to have approximately 180° C. Accordingly, in this period, the thermopile 46 outputs approximately 2.88 V as a voltage corresponding to 180° C. (see table T1*b*), based on the temperature detected from the fixing belt 43.

After this, when a print is started and paper passes the fixing nip and between the fixing belt 43 and the thermopile 46, the thermopile 46 detects a temperature of the paper. Since the temperature of the paper is far lower than that of the fixing belt 43, and the heat radiation rate of the paper is lower than that of the fixing belt 43, the voltage value output from the thermopile 46 drastically falls. In the example shown in FIG. 5, the output voltage value falls to approximately 1.45 V (corresponding to 95° C.: see table T1*a*). This specific value of the temperature falling may be obtained, for example, by a measuring experiment. Also, an intermediate value (at point "a" shown in FIG. 5) between 2.88V, a voltage value in the no-paper passing time, and 1.45V, a voltage value in the paper passing time may be set as a judgment standard value to be used by the CPU 61 for the judgment of the paper passing and no-paper passing. The judgment standard value is stored in the RAM 63. Hereinafter, the judgment standard value is referred to as "paper passing judgment standard value".

The following will describe a detailed procedure. After a print is started, the CPU 61 obtains the output voltage value of the thermopile 46 every 30 ms, three times in total, and sets the average value thereof as a no-paper passing time voltage value. This is because the response speed of the thermopile 46 is 30 ms.

Thereafter, the CPU 61 executing the paper passing judgment program 64*a* obtains the output voltage value of the thermopile 46 every 30 ms, and compares the obtained output voltage value with the average value (no-paper passing time voltage value) of the previous three times (at 30 ms, 60 ms, and 90 ms before the current round), and when the obtained voltage value is lower than the no-paper passing time voltage value and the paper passing judgment standard value (at point "a" shown in FIG. 5), judges that the paper is passing.

Even after it is judged that it is the paper passing time, the CPU 61 obtains the output voltage value of the thermopile 46 every 30 ms, three times in total, and sets the average value thereof as a paper passing time voltage value. Thereafter, the CPU 61 executing the paper passing judgment program 64*a* obtains the output voltage value of the thermopile 46 every 30 ms, and compares the obtained output voltage value with the average value (paper passing time voltage value) of the first three times. As long as the paper passing state continues, the output voltage value of the thermopile 46 should continue to be low, and the CPU 61 executing the paper passing judgment program 64*a* should continue to judge that the paper is passing.

On the other hand, when the rear end of the paper has passed the fixing nip and between the fixing belt 43 and the thermopile 46, and no paper is passing there, the thermopile 46 detects the temperature of the fixing belt 43 again. The obtained voltage value rises exceeding the paper passing judgment standard value. Detecting this rise in temperature (point b in FIG. 5), the CPU 61 judges that no paper is passing.

After this, when another sheet of paper passes (for example, in the case where the second sheet of paper or after is fed to the fixing nip by one print job that should form images of a plurality of pieces of paper), the output voltage value of the thermopile 46 drastically falls from the no-paper passing time voltage value exceeding the paper passing judgment standard value. Detecting this fall in temperature, the CPU 61 executing the paper passing judgment program 64*a* judges that paper is passing.

In this way, the CPU 61 executing the paper passing judgment program 64*a* judges paper passing or no-paper passing depending on the change in the output voltage value of the thermopile 46.

Note that the paper passing judgment standard value at the rise of voltage may be the same as that at the fall of voltage, or the values may be different from each other and the different values may be stored in the RAM 63.

3-2 Temperature Adjustment Control

As similar to the first threshold value, a temperature of the paper at which an optimum fixing state is obtained is determined by a measuring experiment or the like, and the determined value is stored in the RAM 63 as a threshold value. In the example shown in FIG. 5, the threshold value is 95° C. Hereinafter, the threshold value for the temperature of the paper is referred to as the second threshold value.

The CPU 61 executing the temperature adjustment program 64*b* controls ON/OFF of the heater 42 to optimize the fixing of the image to the paper, based on the temperature corresponding to the output voltage value of the thermopile 46 and the first and second threshold values having been determined as described above.

More specifically, during the no-paper passing time, the CPU 61 executing the temperature adjustment program 64*b* obtains the temperature corresponding to the output voltage value of the thermopile 46 (indicated in the table T1*b*), and sets the obtained temperature as a fixing belt temperature. When the fixing belt temperature is no lower than 180° C. as the first threshold value, the CPU 61 performs a control so that the heater 42 is switched OFF; and when the fixing belt temperature is lower than 180° C. as the first threshold value, the CPU 61 performs a control so that the heater 42 is switched ON. Hereinafter, the temperature adjustment control based on the first threshold value is referred to as "temperature adjustment control 1".

Similarly, during the paper passing time, the CPU 61 executing the temperature adjustment program 64*b* obtains the temperature corresponding to the output voltage value of the thermopile 46 (indicated in the table T1*a*), and sets the obtained temperature as a paper temperature. When the paper temperature is no lower than 95° C. as the second threshold value, the CPU 61 performs a control so that the heater 42 is switched OFF; and when the paper temperature is lower than 95° C. as the second threshold value, the CPU 61 performs a control so that the heater 42 is switched ON. Hereinafter, the temperature adjustment control based on the second threshold value is referred to as "temperature adjustment control 2".

4. Operation

Next, the operation of the image forming device 1 after the power-on to a start of print operation, and the operation during the print operation will be described with reference to the flowcharts shown in FIGS. 6 and 7.

Figure 6:
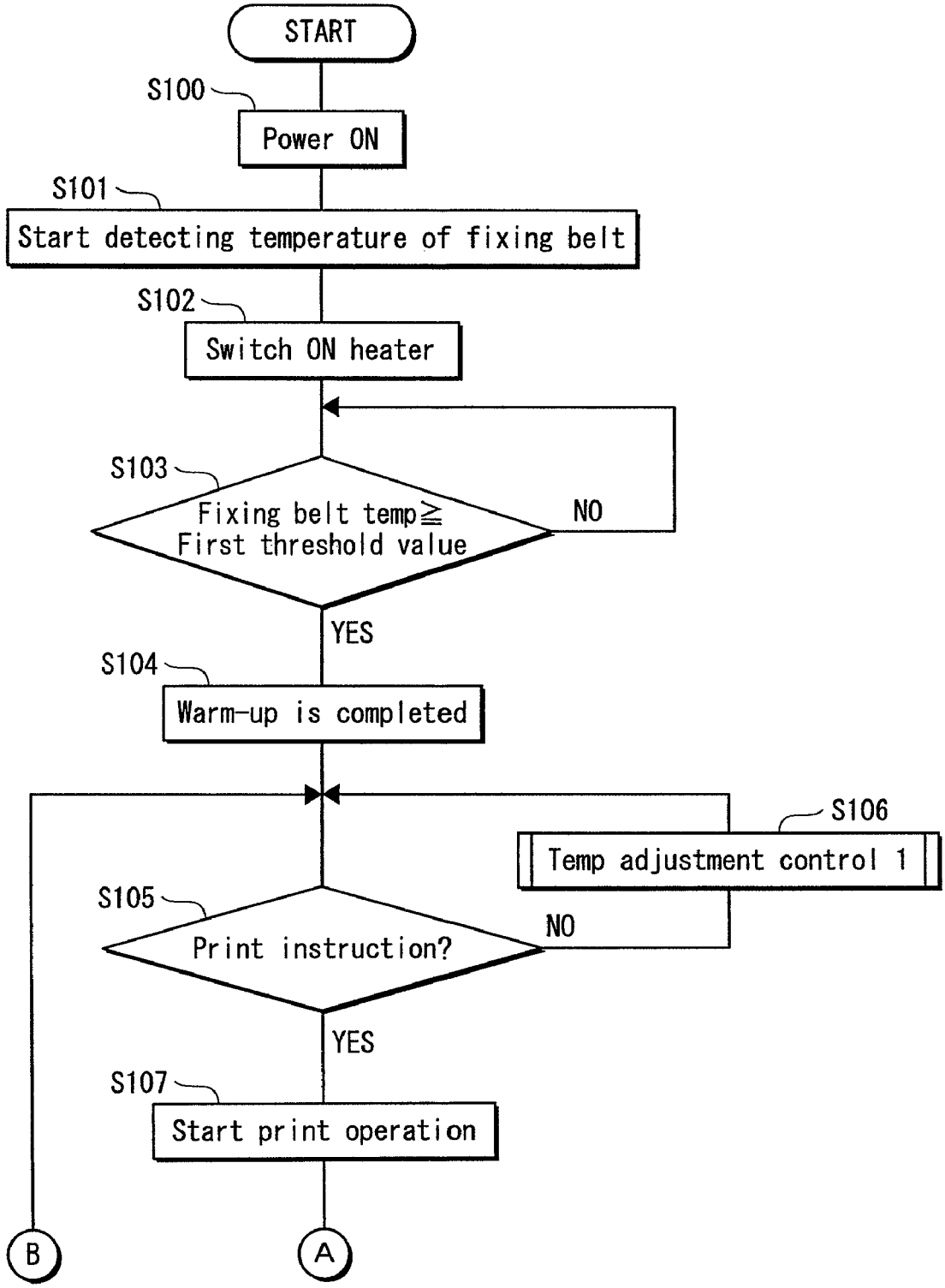
FIG. 6 is a flowchart showing the operation of the image forming device 1.

First, as shown in FIG. 6, after the image forming device 1 is powered on (step S100), the thermopile 46 starts detecting a temperature (step S101). At this time, no paper is passing. Thus, the thermopile 46 detects the temperature of the fixing belt 43, and the output voltage of the thermopile 46 is converted into a temperature based on the table T1*b*.

Under the control performed by the control unit 60, the heater 42 is switched ON and the fixing belt 43 starts to be heated (step S102).

After the heater 42 is switched ON, the control waits until the thermopile 46 detects that the temperature of the fixing belt 43 has increased to 180° C. (the first threshold value) or higher due to the heating by the heater 42 (NO in step S103).

When the thermopile 46 detects that the temperature of the fixing belt 43 has increased to 180° C. (the first threshold value) or higher due to the heating by the heater 42 (YES in step S103), it is determined that the warm-up is completed (step S104).

After the warm-up is completed until an instruction to execute a print job is received from outside the device or from the operation unit 70, namely, during the wait state (NO in step S105), the CPU 61 executes the temperature adjustment program 64*b* to perform the temperature adjustment control 1 (step S106).

Here, the temperature adjustment control 1 will be described in detail with reference to the flowchart shown in FIG. 8.

Figure 8:
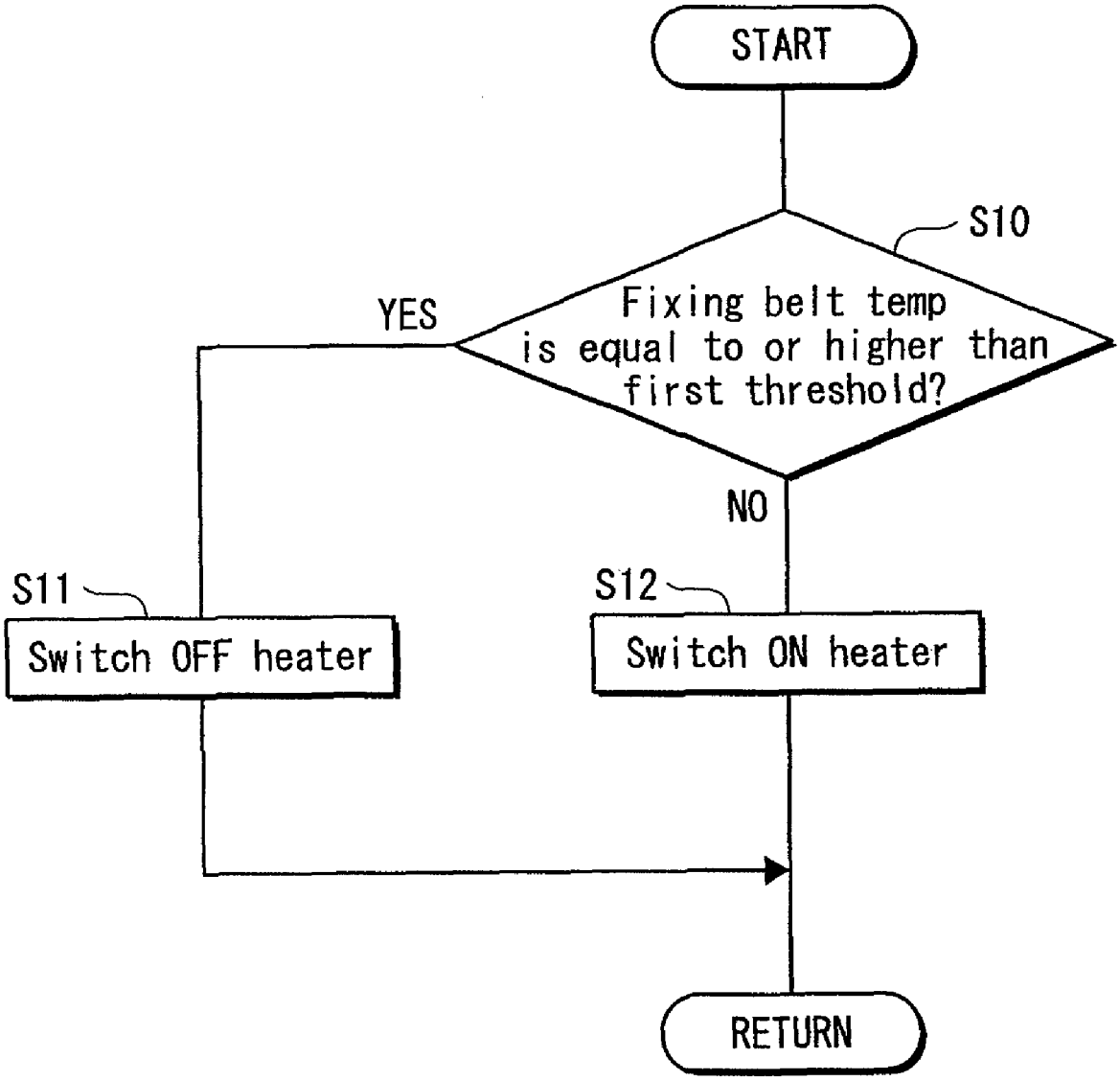
FIG. 8 is a flowchart showing the temperature adjustment control 1 in detail.

First, as shown in FIG. 8, in the temperature adjustment control 1 the CPU 61 obtains the fixing belt temperature by converting the output voltage value of the thermopile 46 into a temperature based on the table T1*b*, and judges whether or not the fixing belt temperature is 180° C. (the first threshold value) or higher (step S10).

When it is judged that the fixing belt temperature is 180° C. or higher (YES in step S10), the CPU 61 performs a control so that the heater 42 is switched OFF (step S11).

On the other hand, when it is judged that the fixing belt temperature is lower than 180° C. (NO in step S10), the CPU 61 performs a control so that the heater 42 is switched ON (step S12).

After the warm-up is completed, when it receives an instruction to execute a print job from outside the device or from the operation unit 70 (YES in step S105), the image forming device 1 starts a print operation (step S107).

After the start of the print operation, the CPU 61 obtains the output voltage value of the thermopile 46 (step S108). Note that immediately after a start of print operation, the CPU 61 obtains the output voltage value of the thermopile 46 three times, obtains an average value thereof, and stores the obtained average value onto the RAM 63 (step S108). This average value of the output voltage values is set as the initial no-paper passing time voltage value.

The CPU 61 performs the temperature adjustment control 1 by executing the temperature adjustment program 64*b* (step S109). The CPU 61 then executes the paper passing judgment program 64*a* to compare the output voltage value obtained at this time with the no-paper passing time voltage value stored onto the RAM 63 in step S108, and judge whether or not paper is passing, depending on whether the output voltage value of the thermopile 46 is lower than the paper passing judgment standard value (step S110).

As far as the CPU 61 judges that no paper is passing (NO in step S110), the CPU 61 continues to perform the temperature adjustment control 1 by executing the temperature adjustment program 64*b* and obtaining the output voltage value of the thermopile 46. In each round of the repetitive process, the CPU 61 discards the oldest output value (output value of 90 ms before the current round) obtained in previous step S108, obtains an average value of three values including a new output value obtained in the current round, and updates the no-paper passing time voltage value.

On the other hand, when the CPU 61 judges that paper is passing (YES in step S110), the CPU 61 obtains the output voltage value of the thermopile 46 (step S111). As similar to step S108, first, the CPU 61 obtains the output voltage value of the thermopile 46 three times, obtains an average value thereof, and stores the obtained average value onto the RAM 63. This average value of the output voltage values is set as the initial paper passing time voltage value.

Following this, the CPU 61 performs the temperature adjustment control 2 by executing the temperature adjustment program 64*b* (step S112).

Here, the temperature adjustment control 2 will be described in detail with reference to the flowchart shown in FIG. 9.

Figure 9:
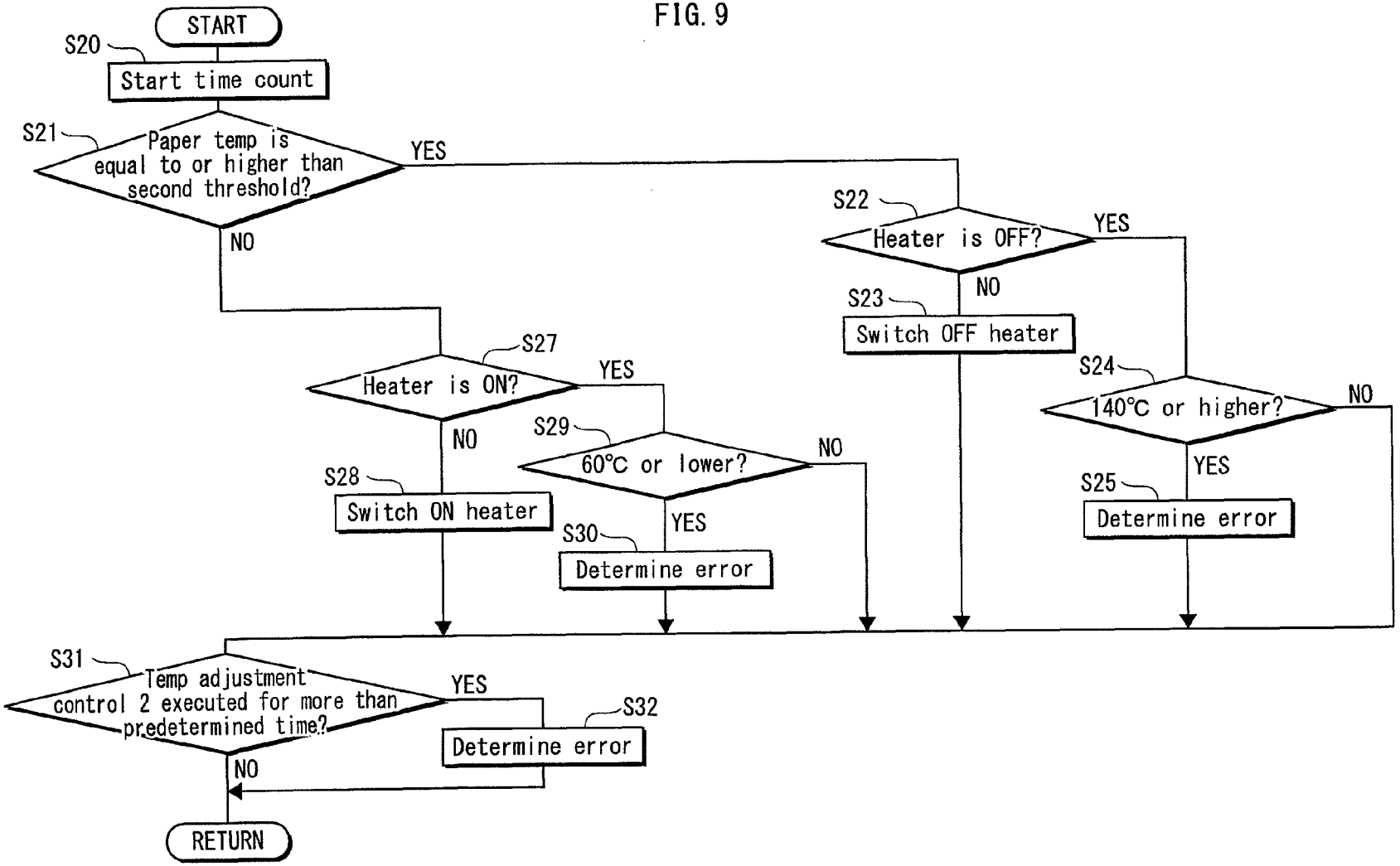
FIG. 9 is a flowchart showing the temperature adjustment control 2 in detail.

First, as shown in FIG. 9, in the temperature adjustment control 2, the CPU 61 starts a time count (step S20). The time count is accumulated as far as the performance of the temperature adjustment control 2 continues.

Next, the CPU 61 obtains a temperature value by converting the output voltage value of the thermopile 46 into a temperature based on the table T1*a*, and judges whether or not the paper temperature is 95° C. (the second threshold value) or higher (step S21).

When it is judged that the paper temperature is 95° C. or higher (YES in step S21), the CPU 61 judges whether the heater 42 is OFF (step S22).

When it is judged that the heater 42 is ON (NO in step S22), the CPU 61 performs a control to switch OFF the heater 42 (step S23). When it is judged that the heater 42 is OFF (YES in step S22), the CPU 61 judges whether the paper temperature is 140° C. or higher (step S24), and when the paper temperature is 140° C. or higher (YES in step S24), the CPU 61 determines that an error has occurred (step S25).

When it is judged that the paper temperature is lower than 140° C. (NO in step S24), the CPU 61 moves to step S31 without performing any step.

Meanwhile, when it is judged that the paper temperature is lower than 95° C. (NO in step S21), the CPU 61 judges whether the heater 42 is ON (step S27).

When it is judged that the heater 42 is OFF (NO in step S27), the CPU 61 perform a control to switch ON the heater 42 (step S28). When it is judged that the heater 42 is ON (YES in step S27), the CPU 61 judges whether the paper temperature is 60° C. or lower (step S29), and when the paper temperature is 60° C. or lower (YES in step S29), the CPU 61 determines that an error has occurred (step S30).

When the paper temperature is higher than 60° C. (NO in step S29), the CPU 61 moves to step S31 without performing any step.

The CPU 61 judges whether a time period indicated by the counts having been accumulated from step S20 has exceeded a predetermined time period, namely, whether the temperature adjustment control 2 has been executed for more than the predetermined time period (step S31).

When it is judged that the temperature adjustment control 2 has been executed for more than the predetermined time period (YES in step S31), namely, when it is judged that the state where the output voltage of the thermopile 46 does not rise (NO in step S113) has continued for more than the predetermined time period, the CPU 61 determines that an error has occurred (step S32).

Note that the manufacturer may conduct an experiment for measuring a time period that is required for the paper to pass between the fixing belt 43 and the thermopile 46 completely, and the predetermined time period may be determined based on the measured value and stored onto the RAM 63.

After the temperature adjustment control 2 is completed, the CPU 61 executes the paper passing judgment program 64*a* to compare the output voltage value obtained at this time with the output voltage value obtained at this time with the output voltage value obtained in step S111, and judge whether or not the state has changed from the paper passing time to the no-paper passing time, depending on whether the output voltage value of the thermopile 46 has risen to be higher than the paper passing judgment standard value (step S113).

As far as it is judged that paper is passing (NO in step S113), the CPU 61 continues to perform the temperature adjustment control 2 by obtaining the output voltage value of the thermopile 46. In step S111 of each round of the repetitive process, the CPU 61 discards the oldest output value (output value of 90 ms before the current round) obtained in previous step S111, obtains an average value of three values including a new output value obtained in the current round, and updates the paper passing time voltage value.

On the other hand, when it is judged that no paper is passing (YES in step S113), the CPU 61 obtains the output voltage value of the thermopile 46 three times, calculates an average value thereof, and stores the calculated average value onto the RAM 63 (step S114). The output voltage value stored here is the latest output voltage value for the no-paper passing time.

Note that when it is judged that no paper is passing (YES in step S113), it indicates that at the very moment, an image has been fixed onto a piece of paper.

Following this, the CPU 61 performs an error control by executing the error control program 64*c* (step S115).

Here, the error control will be described in detail with reference to the flowchart shown in FIG. 10.

Figure 10:
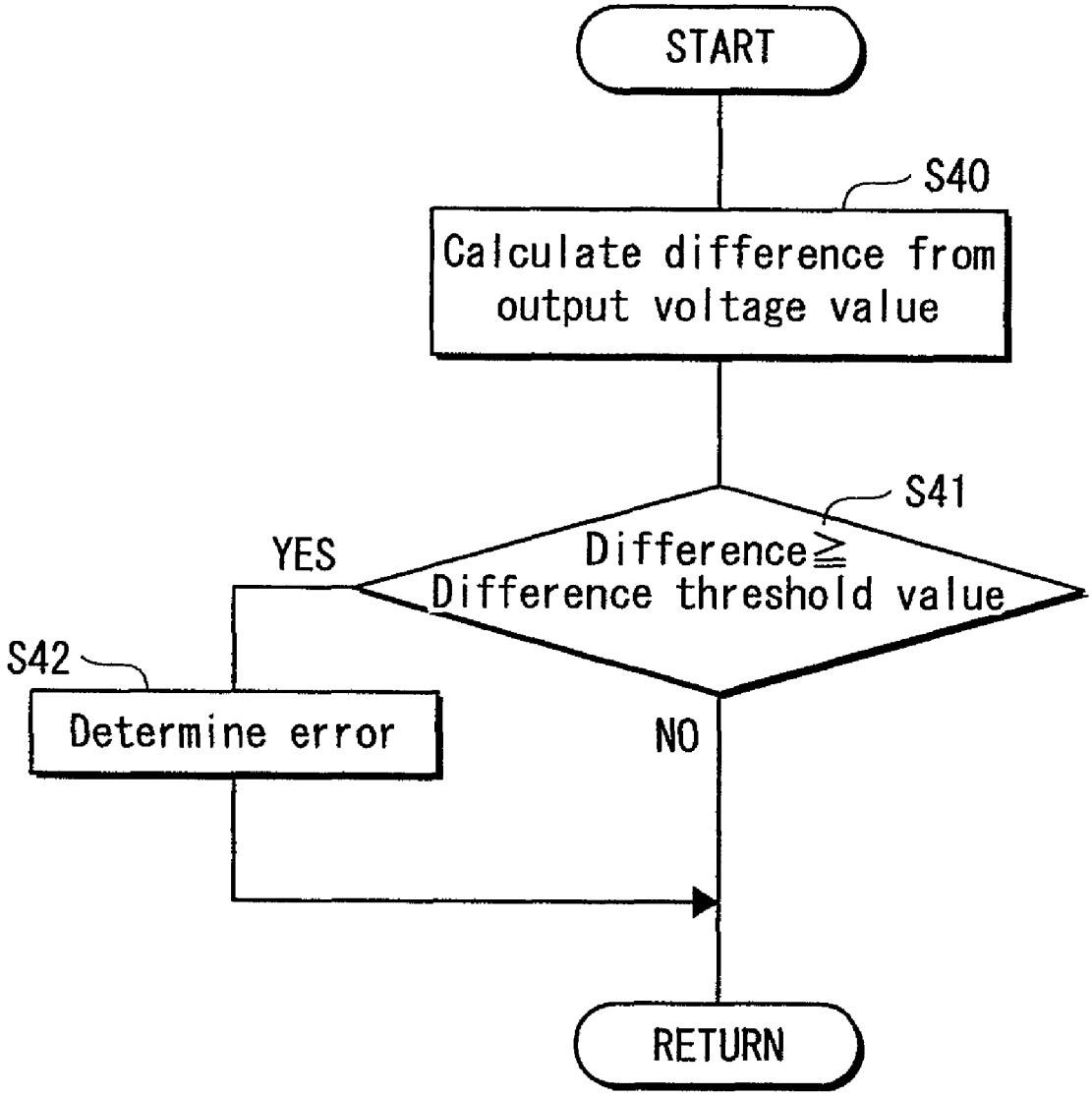
FIG. 10 is a flowchart showing the error control in detail.

First, as shown in FIG. 10, in the error control, the CPU 61 calculates a difference between the output voltage value obtained in step S111 and the average value calculated and stored in step S114 (step S40).

The CPU 61 then judges whether the calculated difference is equal to or greater than a predetermined difference threshold value (step S41).

When it is judged that the calculated difference is smaller than the predetermined difference threshold value (NO in step S41), the process ends.

On the other hand, when it is judged that the calculated difference is equal to or greater than the predetermined difference threshold value (YES in step S41), the CPU 61 determines that an error has occurred (step S42).

Note that the manufacturer may conduct an experiment for detecting an abnormal value that is obtained when a disconnection or a failure of the thermopile 46 occurs, determine the detected abnormal value as the predetermined difference threshold value, and preliminarily store the predetermined difference threshold value onto the RAM 63.

After the error control is completed, the CPU 61 judges whether the print should end (step S116). More specifically, the CPU 61 judges that the print should end (YES in step S116) when the number of prints specified by the print job is one. This is because, when only one print has been specified, there is no need to print any more.

On the other hand, when the number of prints specified by the print job is two or more, there is a need to print more, and the CPU 61 judges that the print should not end (NO in step S116), and returns to step S108.

As described above, in the wait state, the image forming device 1 performs the temperature adjustment control 1 based on the temperature of the fixing belt 43 detected by the thermopile 46; and during an execution of a print job, the image forming device 1 performs the temperature adjustment control 1 during the no-paper passing time, and performs the temperature adjustment control 2 during the paper passing time.

Accordingly, with the above-described structure, the image forming device 1 can perform a highly accurate temperature adjustment in the wait state or in the no-paper passing time or paper passing time during an execution of a print, and can optimize the fixing of the image to the paper.

Also, under the temperature adjustment control 2, when the paper temperature is 60° C. or lower even when the heater 42 is ON, or when the paper temperature is 140° C. or higher even when the heater 42 is OFF, it is expected that a failure of the heater 42 or the like has occurred. In that case, it is possible to determine that an error has occurred.

Also, when the output voltage of the thermopile 46 does not rise and the temperature adjustment control 2 continues to be performed even after a time period in which the paper should completely pass between the fixing belt 43 and the thermopile 46, it is expected that some abnormality such as a paper jam or paper curling has occurred. In that case, it is possible to determine that an error has occurred.

Further, when there is an extreme difference between the fixing belt temperature and the paper temperature, it is expected that some abnormality such as a disconnection or a failure of the thermopile 46 has occurred. In that case, it is possible to determine that an error has occurred.

Embodiment 2

In Embodiment 1, the image forming device 1 judges whether paper is passing or not, during a print operation. In Embodiment 2, when paper is passing, an image forming device 2 further judges which type of paper among a plurality of types of paper is passing.

In the following, only differences from Embodiment 1 will be described, and description of the same portions as in Embodiment 1 will be omitted.

1. Structure

Figure 11:
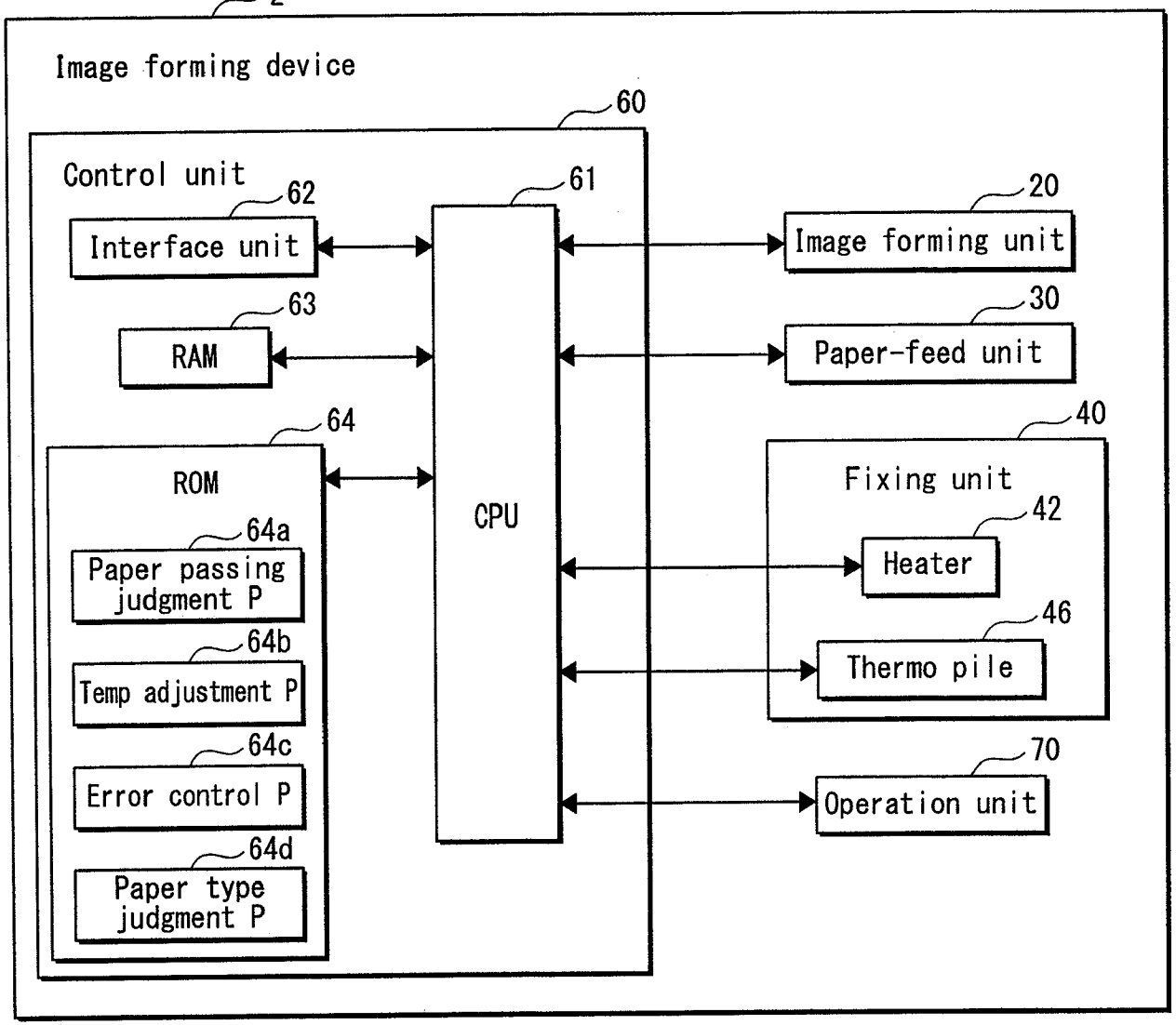
FIG. 11 is a block diagram showing the internal structure of the image forming device 2 in Embodiment 2.

The following describes the internal structure of the image forming device 2 with reference to FIG. 11.

The ROM 64 stores a paper type judgment program 64*d* (paper type judgment P).

The paper type judgment program 64*d* has a function to judge the type of paper while paper is passing, based on the change in the output voltage value of the thermopile 46.

2. Paper Type Judgment

Here, the paper type judgment performed by the paper type judgment program 64*d* will be described with reference to the change in the output voltage value of the thermopile 46 shown in FIG. 12.

There are a plurality of types of paper. It is presumed in the present example that there are four types of paper: thick; thin; regular; and OHP.

Each paper type has a different temperature after the fixing. For example, in the present example, the thick paper has the highest thermal conductivity, and the thin, regular, and OHP papers have lower thermal conductivities in the stated order.

Figure 12:
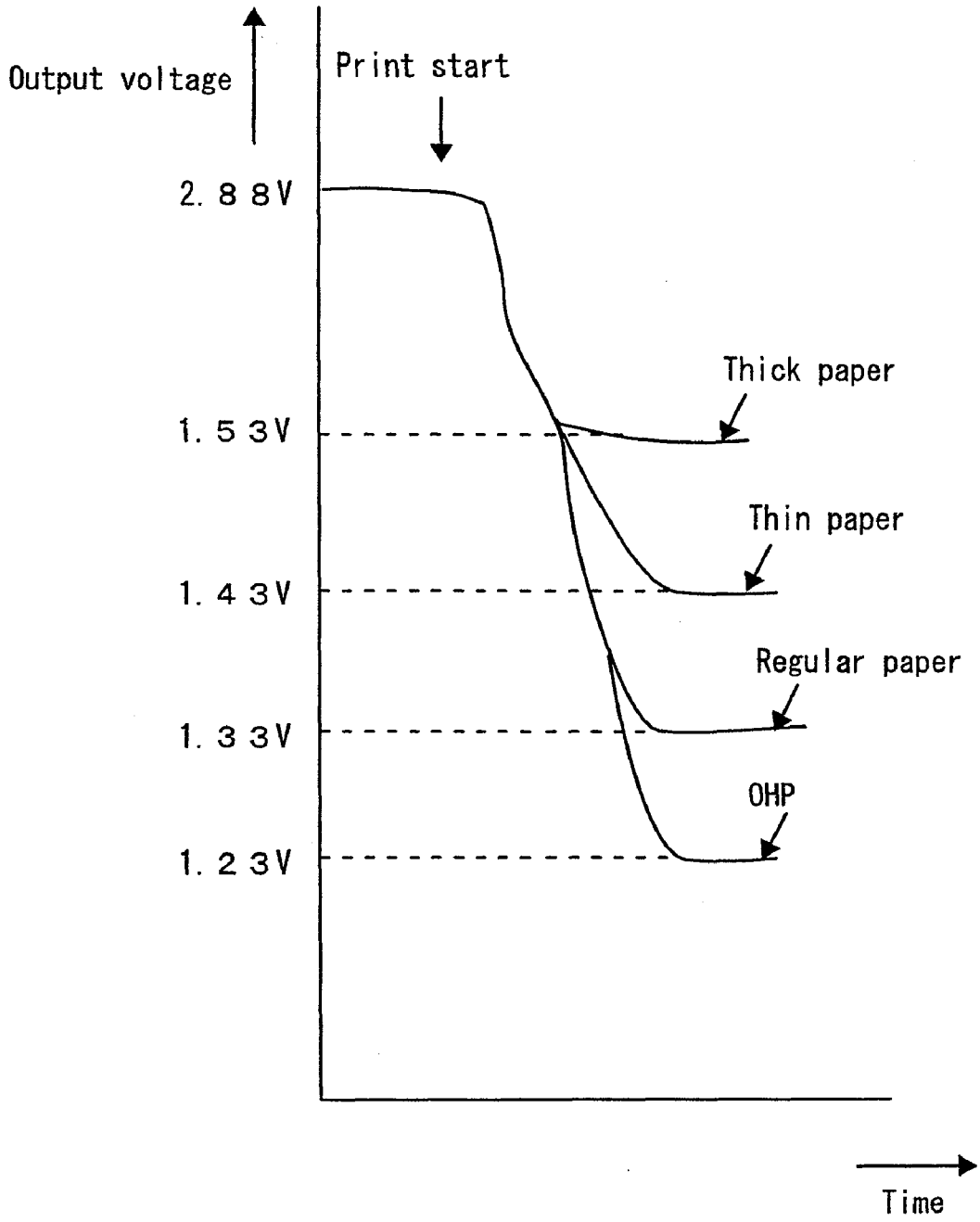
FIG. 12 shows the change in the output voltage of the thermopile 46.

FIG. 12 indicates that: the output voltage falls from 2.88 V to approximately 1.53 V by approximately 1.35 V when the thermopile 46 detects a temperature of thick paper; the output voltage falls from 2.88 V to approximately 1.43 V by approximately 1.45 V when the thermopile 46 detects a temperature of thin paper; the output voltage falls from 2.88 V to approximately 1.33 V by approximately 1.55 V when the thermopile 46 detects a temperature of regular paper; and the output voltage falls from 2.88 V to approximately 1.23 V by approximately 1.65 V when the thermopile 46 detects a temperature of OHP paper. Note that the user may obtain the values of voltage fall, for example, by a measuring experiment. Also, threshold values are set based on these values, respectively. Hereinafter, these threshold values are referred to as paper judgment threshold values.

Also, the optimum fixing temperature differs for each paper type. Accordingly, to perform a different temperature adjustment control for each paper type, threshold values (second threshold values) are preliminarily set. The user may obtain optimum temperatures respectively for the paper types by an operation experiment or the like, and set the optimum temperatures as the second threshold values.

A table T2 indicating the relationships between the paper judgment threshold values, paper types, and second threshold values is then generated and stored in the RAM 63.

As shown in the table T2 in FIG. 13, in the present embodiment: for the thick paper, the paper judgment threshold value is 1.30 V to 1.39 V, and the second threshold value is 100° C.; for the thin paper, the paper judgment threshold value is 1.40 V to 1.49 V, and the second threshold value is 95° C.; for the regular paper, the paper judgment threshold value is 1.50 V to 1.59 V, and the second threshold value is 90° C.; and for the OHP paper, the paper judgment threshold value is 1.60 V or higher, and the second threshold value is 85° C.

3. Temperature Adjustment Control

When paper is passing, the CPU 61 executing the temperature adjustment program 64*b* performs the temperature adjustment control 2 based on the second threshold value corresponding to the type of the passing paper.

When the thick paper is passing, the CPU 61 performs a control to switch OFF the heater 42 when the temperature corresponding to the output voltage value of the thermopile 46 (indicated in the table T1*a*) is 100° C. (the second threshold value) or higher, and performs a control to switch ON the heater 42 when the temperature corresponding to the output voltage value of the thermopile 46 is lower than 100° C. (the second threshold value).

Similarly: when the thin paper is passing, the CPU 61 performs a control to switch OFF the heater 42 when the temperature corresponding to the output voltage value of the thermopile 46 is 95° C. or higher, and performs a control to switch ON the heater 42 when the temperature corresponding to the output voltage value of the thermopile 46 is lower than 95° C.; when the regular paper is passing, the CPU 61 performs a control to switch OFF the heater 42 when the temperature corresponding to the output voltage value of the thermopile 46 is 90° C. or higher, and performs a control to switch ON the heater 42 when the temperature corresponding to the output voltage value of the thermopile 46 is lower than 90° C.; and when the OHP paper is passing, the CPU 61 performs a control to switch OFF the heater 42 when the temperature corresponding to the output voltage value of the thermopile 46 is 85° C. or higher, and performs a control to switch ON the heater 42 when the temperature corresponding to the output voltage value of the thermopile 46 is lower than 85° C.

Note that, in the present embodiment, the same temperature adjustment control 1 described in Embodiment 1 is performed when no paper is passing.

4. Operation

Next, the operation of the image forming device 2 will be described.

Figure 7:
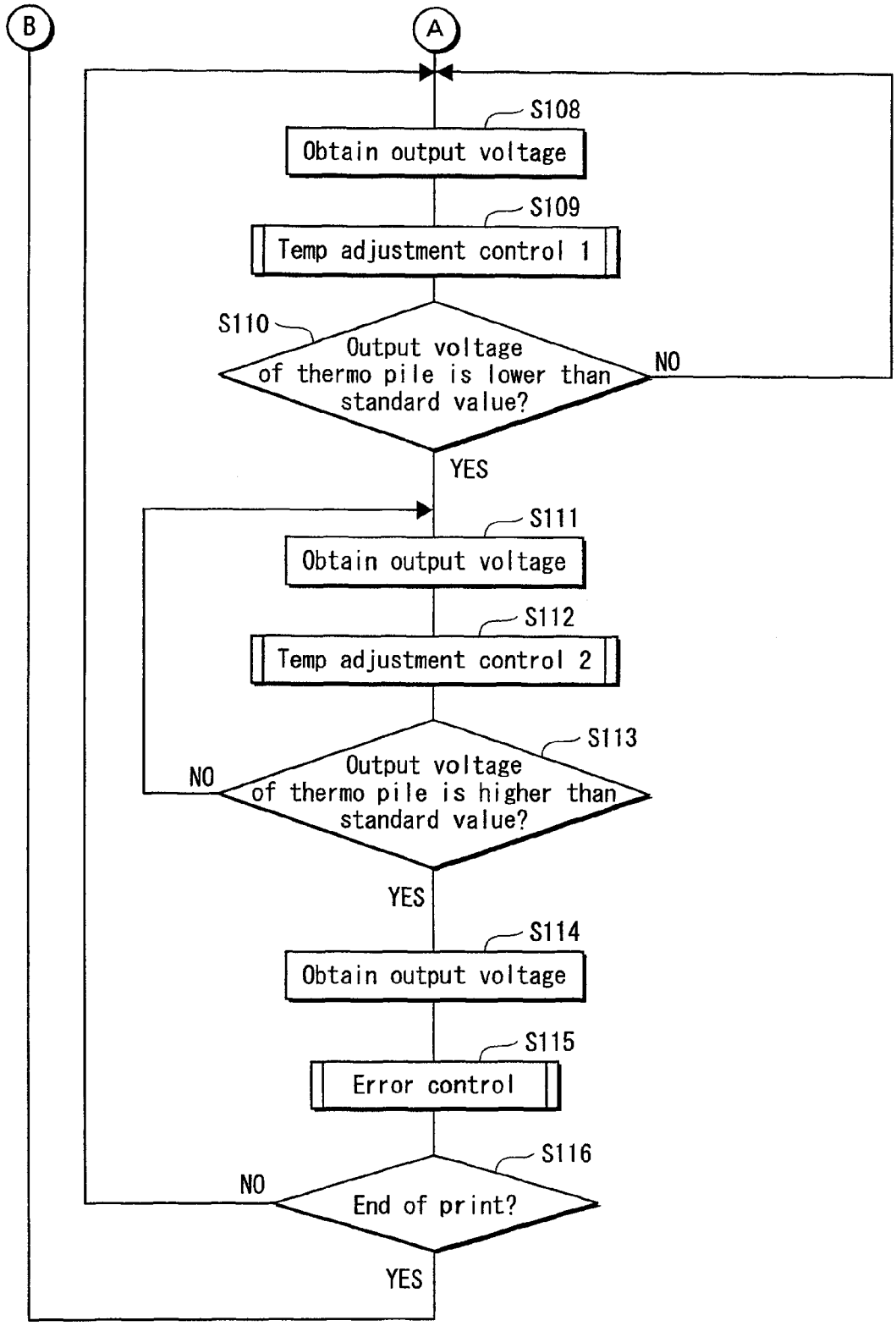
FIG. 7 is a flowchart showing the operation of the image forming device 1.

As similar to the image forming device 1 in Embodiment 1, the image forming device 2 performs the pre-print-operation process (FIG. 6, steps S100-S107) and the print-operation process (FIG. 7, steps S108-S116). The operation performed by the image forming device 2 differs from the operation performed by the image forming device 1 in the temperature adjustment control 2.

The temperature adjustment control 2 performed by the image forming device 2 will be described with reference to the flowchart shown in FIG. 14.

Figure 14:
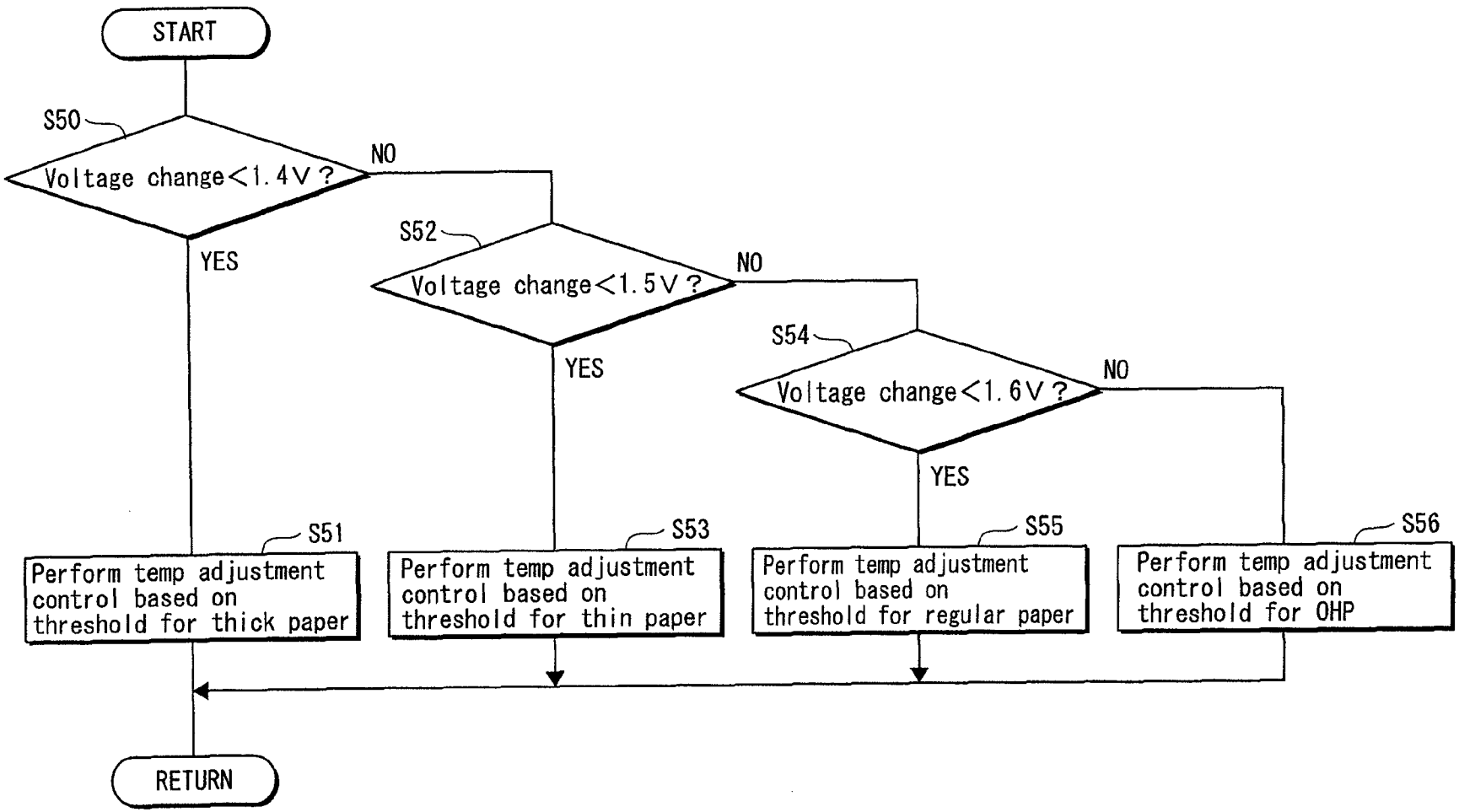
FIG. 14 is a flowchart of the temperature adjustment control 2 performed by the image forming device 2.

As shown in FIG. 14, the CPU 61 determines the paper type by checking the output voltage fall (difference) value of the thermopile 46.

When the output voltage fall value is lower than 1.4 V (YES in step S50), the CPU 61 determines that the passing paper is thick paper, and performs the temperature adjustment control 2 as shown in FIG. 9 based on 100° C. that is the second threshold value of the thick paper (step S51).

When the output voltage fall value is 1.4 V or higher (NO in step S50) and is lower than 1.5 V (YES in step S52), the CPU 61 determines that the passing paper is thin paper, and performs the temperature adjustment control 2 as shown in FIG. 9 based on 95° C. that is the second threshold value of the thin paper (step S53).

When the output voltage fall value is 1.5 V or higher (NO in step S52) and is lower than 1.6 V (YES in step S54), the CPU 61 determines that the passing paper is regular paper, and performs the temperature adjustment control 2 as shown in FIG. 9 based on 90° C. that is the second threshold value of the regular paper (step S55).

When the output voltage fall value is 1.6 V or higher (NO in step S54), the CPU 61 determines that the passing paper is OHP paper, and performs the temperature adjustment control 2 as shown in FIG. 9 based on 85° C. that is the second threshold value of the OHP paper (step S56).

With the above-described operation, the image forming device 2 can control the heater using an optimum threshold values corresponding to the paper types during the print operation.

Furthermore, temperatures corresponding to the paper types may be used in the error determination performed in steps S24 and S29 shown in FIG. 9.

Embodiment 3

In Embodiment 3, during a print operation, an image forming device 3 further judge whether it is printing the first print page or the last print page, considering the double-face printing.

In the following, only differences from Embodiment 1 will be described, and description of the same portions as in Embodiment 1 will be omitted.

1. Structure

Figure 15:
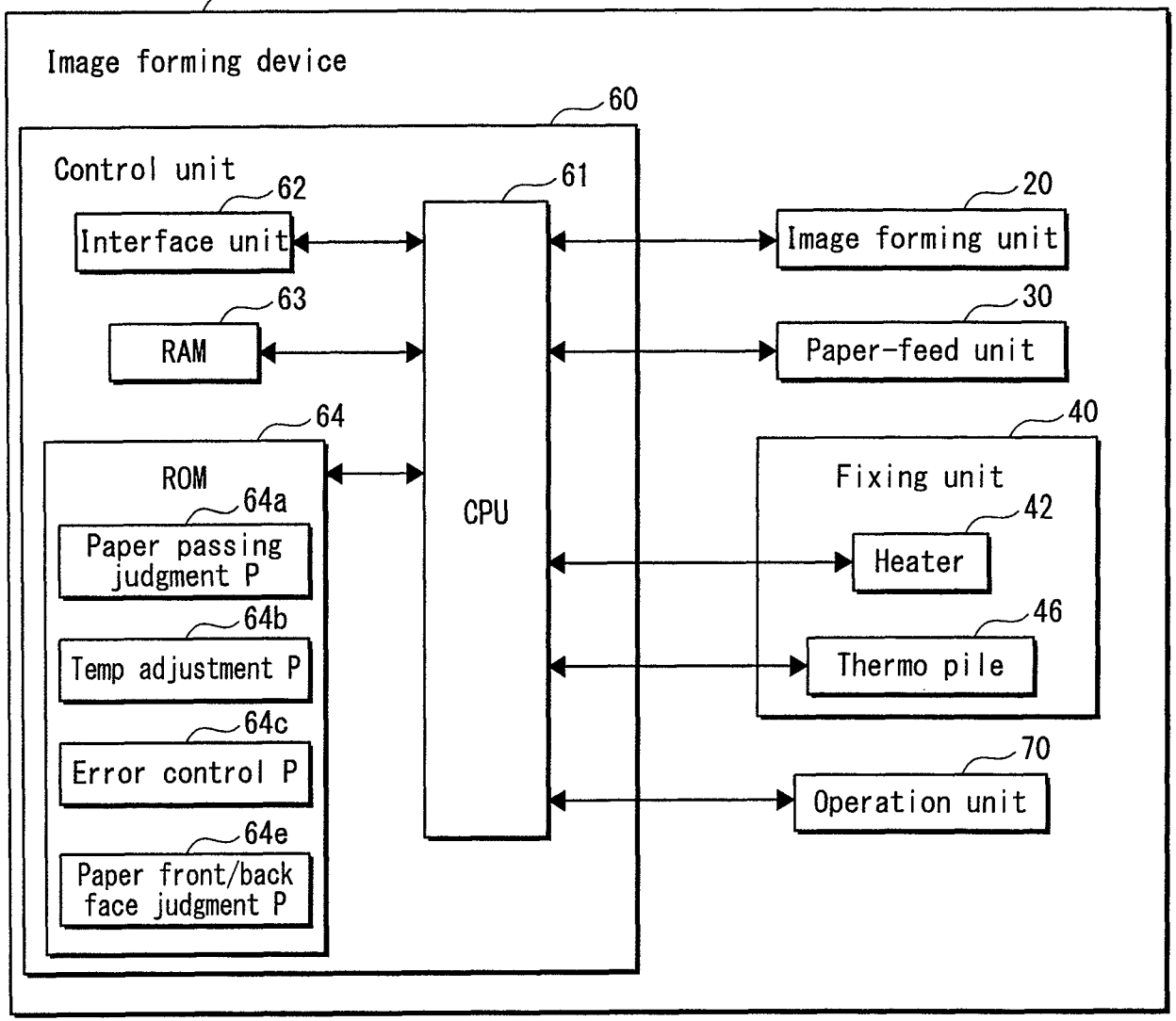
FIG. 15 is a block diagram showing the internal structure of the image forming device 3.

The following describes the internal structure of the image forming device 3 with reference to FIG. 15.

The ROM 64 stores a paper front/back face judgment program 64*e* (paper front/back face judgment P).

The paper front/back face judgment program 64*e* has a function to, upon receiving a double-face print job from outside the device or from the operation unit 70, judge whether a print operation being executed is an operation for forming an image on the first print page (front face) or on the last print page (back face), based on the received print job.

Also, in Embodiment 3, the temperature adjustment program 64*b* performs the temperature adjustment control 2 based on the second threshold value as in Embodiment 1 when the paper front/back face judgment program 64*e* judges that it is printing the front face of the paper, and performs the temperature adjustment control 2 based on a third threshold value, which is different from the second threshold value, when the paper front/back face judgment program 64*e* judges that it is printing the back face of the paper.

That is to say, the paper passes the fixing nip once when an image is formed onto the front face of the paper, and then the paper passes the fixing nip again when an image is formed onto the back face of the paper, and at this time, the paper has already been warmed. For this reason, the third threshold value may be lower than the second threshold value that is used when an image is formed onto the front face of the paper.

Note that the manufacturer may conduct an operation experiment to determine optimum value of the third threshold value. Both the third and second threshold values are stored in the RAM 63. In the present example, it is presumed that the third threshold value is 90° C. that is 5° C. lower than the second threshold value (95° C.).

2. Operation

Next, the operation of the image forming device 3 will be described.

As similar to the image forming device 1 in Embodiment 1, the image forming device 3 performs the pre-print-operation process (FIG. 6, steps S100-S107) and the print-operation process (FIG. 7, steps S108-S116). The operation performed by the image forming device 3 differs from the operation performed by the image forming device 1 in the temperature adjustment control 2.

The temperature adjustment control 2 performed by the image forming device 3 will be described with reference to the flowchart shown in FIG. 16.

Figure 16:
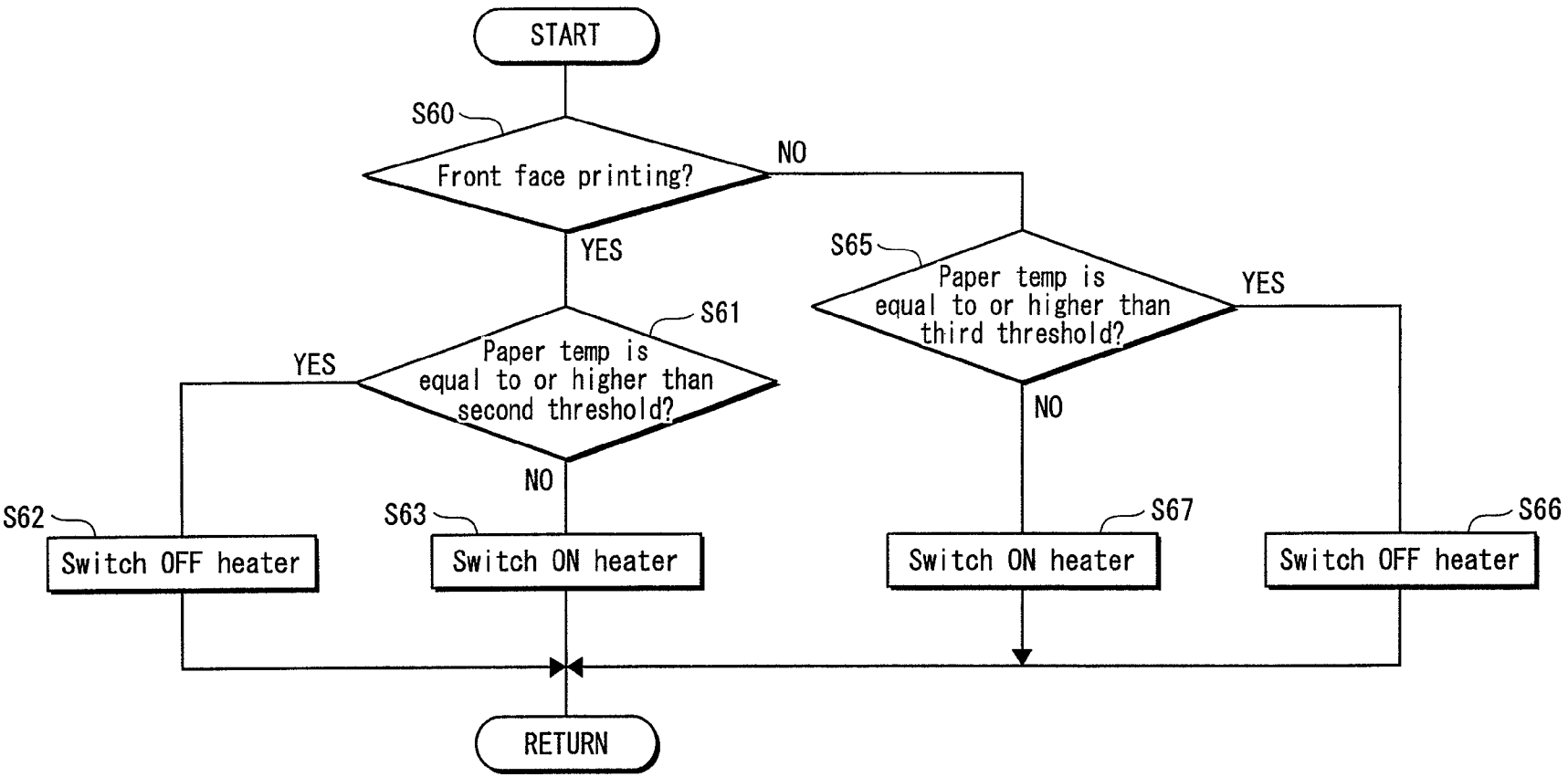
FIG. 16 is a flowchart of the temperature adjustment control 2 performed by the image forming device 3.

As shown in FIG. 16, the CPU 61 judges whether a printing is performed onto the front face of the paper, namely, the front face of the paper is passing (step S60).

When it is judged that the printing is performed onto the front face of the paper (YES in step S60), the CPU 61 performs the temperature adjustment control 2 based on the second threshold value. That is to say, when it is judged that the paper temperature is equal to or higher than the second threshold value (95° C.) (YES in step S61), the CPU 61 performs a control to switch OFF the heater 42 (step S62); and when it is judged that the paper temperature is lower than the second threshold value (95° C.) (NO in step S61), the CPU 61 performs a control to switch ON the heater 42 (step S63).

On the other hand, when it is judged that the printing is performed onto the back face of the paper (NO in step S60), the CPU 61 performs the temperature adjustment control based on the third threshold value. That is to say, when it is judged that the paper temperature is equal to or higher than the third threshold value (90° C.) (YES in step S65), the CPU 61 performs a control to switch OFF the heater 42 (step S66); and when it is judged that the paper temperature is lower than the third threshold value (90° C.) (NO in step S65), the CPU 61 performs a control to switch ON the heater 42 (step S67).

Embodiment 4

In Embodiment 1, in accordance with the paper passing judgment program 64*a* running therein, the image forming device 1 judges whether paper is passing or not based on the change of the output voltage value of the thermopile 46. An image forming device 4 of Embodiment 4 is provided with a paper passing judgment program 64*f*, instead of the paper passing judgment program 64*a*, and in accordance with the paper passing judgment program 64*f* running therein, the image forming device 4 judges whether paper is passing or not based on the paper-feed instruction.

In the following, only differences from Embodiment 1 will be described, and description of the same portions as in Embodiment 1 will be omitted.

1. Structure

Figure 17:
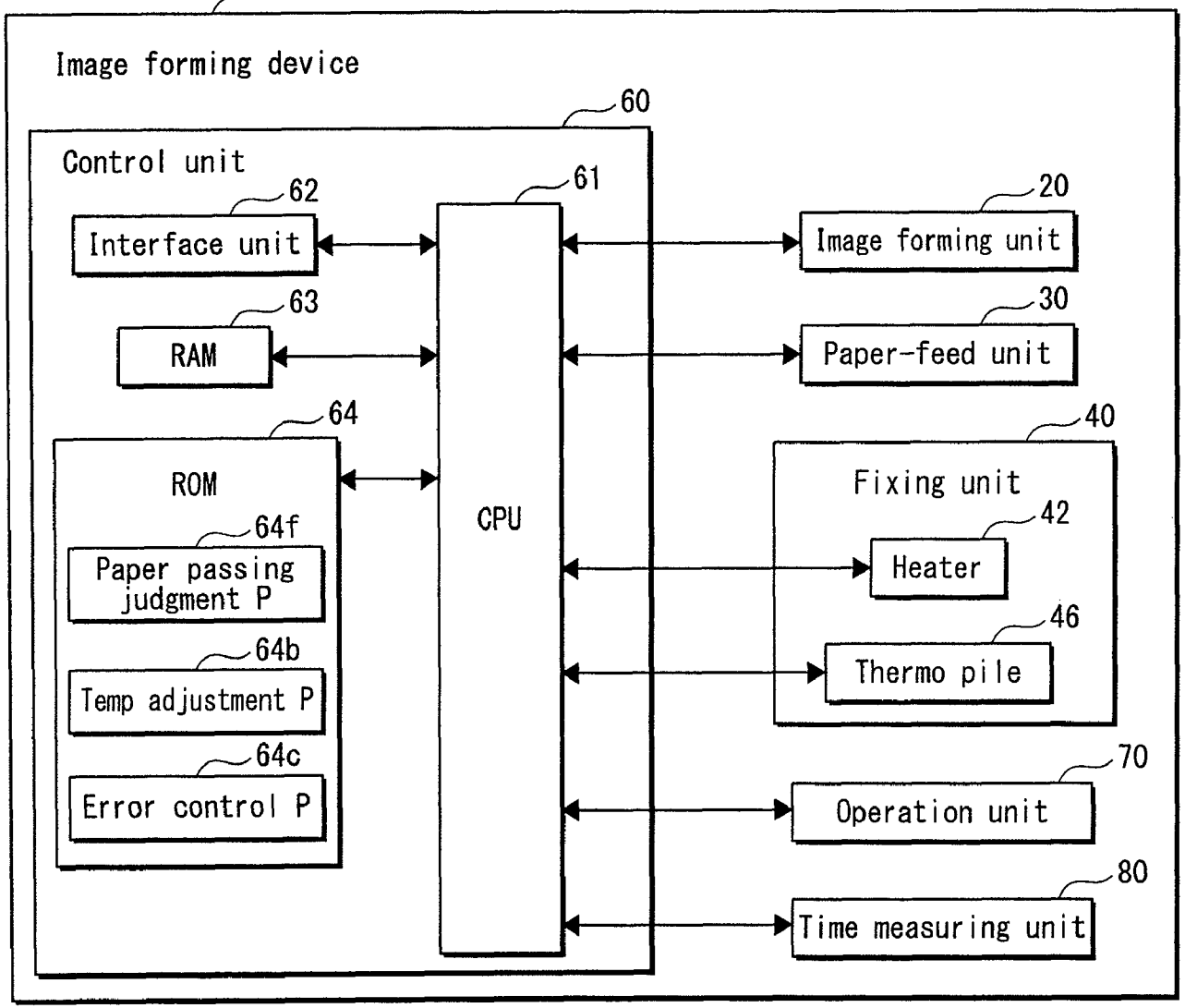
FIG. 17 is a block diagram showing the internal structure of the image forming device 4.

The following describes the internal structure of the image forming device 4 with reference to FIG. 17.

The ROM 64 stores a paper passing judgment program 64*f*.

The paper passing judgment program 64*f* has a function to judge whether or not paper is passing, based on a signal representing the paper-feed instruction that is sent from the control unit 60 to the paper-feed unit 30. More specifically, in the secondary transfer process, the control unit 60 instructs the paper-feed unit 30 to feed the paper to the secondary transfer position to perform the secondary transfer of an image from the intermediate transfer belt 25 to the paper. It is presumed here that, when a predetermined time period (first predetermined time period) passes since the transmission of the instruction signal, the secondary transfer ends and feeds out the paper, and the paper passes the fixing nip and between the fixing belt 43 and the thermopile 46. Based on this, the paper passing judgment program 64*f* judges that paper is passing when the first predetermined time period has passed. Further, when a predetermined time period (second predetermined time period) further passes after the first predetermined time period, the paper has completely passed between the fixing belt 43 and the thermopile 46, and no paper is passing. Based on this, the paper passing judgment program 64*f* judges that no paper is passing when the second predetermined time period has passed.

Note that the manufacturer may conduct an operation experiment or the like and determine the first and second predetermined time periods based on the values measured in the operation experiment, and the first and second predetermined time periods may be stored onto the RAM 63.

The first and second predetermined time periods may be determined, for example, based on a signal representing the instruction for feeding paper to the pair of timing rollers 34 utilizing time measurement unit 80.

2. Operation

Next, the operation of the image forming device 4 will be described.

As similar to the image forming device 1 in Embodiment 1, the image forming device 4 performs the pre-print-operation process (FIG. 6, steps S100-S107). The operation performed by the image forming device 4 differs from the operation performed by the image forming device 1 in the print operation.

Figure 18:
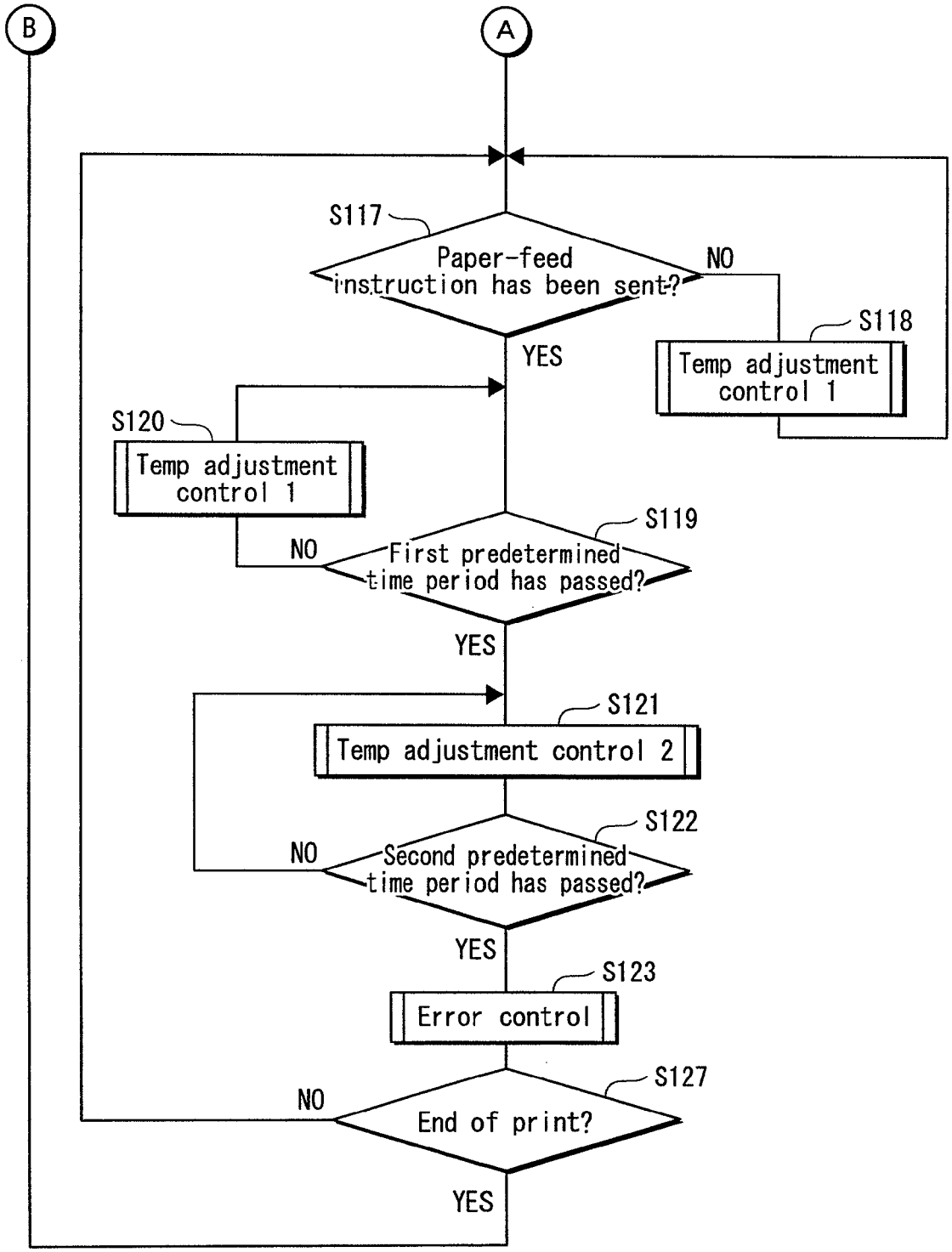
FIG. 18 is a flowchart showing the print operation of the image forming device 4.

The print operation of the image forming device 4 will be described with reference to the flowchart shown in FIG. 18.

After a print operation is started, the CPU 61 executes the paper passing judgment program 64*f* and judges whether a paper-feed instruction has been sent (step S117).

The CPU 61 continues to perform the temperature adjustment control 1 (step S118) as far as it is judged that a paper-feed instruction has not been sent (NO in step S117).

When it is judged that a paper-feed instruction has been sent (YES in step S117), the CPU 61 judges whether the first predetermined time period has passed (step S119). When it is judged that the first predetermined time period has passed (YES in step S119), the CPU 61 judges that paper is passing and performs the temperature adjustment control 2 (step S121). When it is judged that the first predetermined time period has not passed (NO in step S119), the temperature adjustment control 1 (step S120) is performed.

The CPU 61 continues to perform the temperature adjustment control 2 as far as it is judged that the second predetermined time period has not passed (NO in step S122).

When it is judged that the second predetermined time period has passed (YES in step S122), the CPU 61 judges that no paper is passing and performs an error control (step S123), and then judges whether the print should end (S127).

With the above-described structure, the image forming device 4 can judge whether paper is passing or not, based on the paper-feed instruction sent by the control unit 60.

Supplemental Notes

Up to now, image forming devices respectively representing aspects of the present invention have been described in Embodiments 1 through 4. However, the image forming devices 1-4 may be varied in various ways as shown in the following, for example.

(1) In Embodiments 1 through 4, the temperature adjustment program 64*b* converts an output voltage of the thermopile 46 into a temperature by referring to the tables T1*a* and T1*b*, and compares the temperature with the first and second threshold values. However, the present invention is not limited to this structure.

For example, the temperature adjustment program 64*b* may directly compare the output voltage of the thermopile 46 with the threshold values. In this case, the first and second threshold values are voltage values.

Similarly, the error control program 64*c* converts an output voltage of the thermopile 46 into a temperature by referring to the tables T1*a* and T1*b*, and compares the temperature with a predetermined difference threshold value. However, the present invention is not limited to this structure. For example, the error control program 64*c* may directly compare the output voltage of the thermopile 46 with the difference threshold value. In this case, the difference threshold value is a voltage value.

(2) In the temperature adjustment controls in Embodiments 1 through 4, the CPU 61 controls ON/OFF of the heater 42. However, the present invention is not limited to this structure.

When an IH heater is used as the heater 42, the heating temperature can be controlled carefully in detail. Therefore, for example, the heating temperature may be controlled based on a table T3 shown in FIG. 19.

According to the example shown in FIG. 19: when a difference between a temperature corresponding to the output voltage value of the thermopile 46 and the first or second threshold value is "−2° C.", the heating is performed with 240 W; when the difference is "−6° C.", the heating is performed with 320 W; when the difference is "−8° C.", the heating is performed with 360 W; when the difference is "−20° C.", the heating is performed with 600 W; and when the difference is "−32° C.", the heating is performed with 1200 W. These values may be determined as optimum values among the values measured in an experiment performed by the user.

Further, the table T3 may be provided for each type of paper, and the table to be used may be switched, depending on the type of paper that is detected when the temperature adjustment control 2 is performed.

(3) In each of Embodiments 1 through 4, a tandem-type full-color copier is used as an image forming device that represents a corresponding aspect of the present invention. However, the present invention is not limited to this.

The image forming device of the present invention may be a copier of the 4-cycle type or of any other type, a printer, a facsimile machine, or a machine having functions of these, such as an MFP (Multiple Function Peripheral).

(4) In Embodiments 1 through 4, a thermopile being a temperature sensor is used. However, the present invention is not limited to this. Various temperature sensors, such as thermal-type or quantum-type radiation temperature sensor, are usable for the present invention.

(5) In Embodiments 1 through 4, the fixing unit 40 includes a heating roller 41, a heater 42, a fixing belt 43, a fixing roller 44, a pressurizing roller 45, and a thermopile 46. However, the present invention is not limited to this.

The fixing unit may be of a type that is provided with a pad for forming a wider nip, instead of the fixing roller. Also, the fixing unit may be of a type that does not use a fixing belt and includes a heater-embedded fixing roller and a pressure roller. In this type, the fixing roller corresponds to one rotation member of the present invention.

(6) The paper passing judgment program 64*a*, temperature adjustment program 64*b*, error control program 64*c*, paper type judgment program 64*d*, paper front/back face judgment program 64*e*, and paper passing judgment program 64*f* described in Embodiments 1 through 4 may be recorded in any of various computer-readable recording mediums such as magnetic tape, magnetic disk like flexible disk, optical recording medium like DVD-ROM, DVD RAM, CD-ROM, CD-R, MO, and PD, and recording medium like flash memory, and the recording mediums with these programs recorded therein may be manufactured and distributed.

Also, the paper passing judgment program 64*a*, temperature adjustment program 64*b*, error control program 64*c*, paper type judgment program 64*d*, paper front/back face judgment program 64*e*, and paper passing judgment program 64*f* may be transported via a network such as the Internet, broadcast, electric communication line, and/or satellite communication.

SUMMARY

The above-described embodiments and verifications are based on the aspects of the present invention having been described as solving the problem of the related art. The aspects of the present invention are as follows.

One aspect of the present invention is an image forming device for achieving image formation by transporting a recording sheet with an unfixed image formed thereon to pass a fixing nip so that thereby the unfixed image is thermally fixed onto the recording sheet, the fixing nip being formed between two rotation members located closely to each other as a pair, at least one of the two rotation members having been heated by a heater, the image forming device comprising: a temperature sensor located at a position more downstream than the fixing nip in a recording sheet transport direction, and operable to detect a surface temperature of one of the rotation members which is located across a recording sheet transport route from the temperature sensor; a judging part operable to judge whether or not the recording sheet after the fixing is passing between the temperature sensor and the one of the rotation members; and a controller operable to control the heater using a first threshold value and a temperature detected by the temperature sensor when the judging part has judged that the recording sheet is not passing, and to control the heater using a second threshold value, which is different from the first threshold value, and the temperature detected by the temperature sensor when the judging part has judged that the recording sheet is passing.

Another aspect of the present invention is an image forming method for use in an image forming device for achieving image formation by transporting a recording sheet with an unfixed image formed thereon to pass a fixing nip so that thereby the unfixed image is thermally fixed onto the recording sheet, the fixing nip being formed between two rotation members located closely to each other as a pair, at least one of the two rotation members having been heated by a heater, the image forming device including a temperature sensor that is located at a position more downstream than the fixing nip in a recording sheet transport direction, and is operable to detect a surface temperature of one of the rotation members which is located across a recording sheet transport route from the temperature sensor, the image forming method comprising the steps of: judging whether or not the recording sheet after the fixing is passing between the temperature sensor and the one of the rotation members; and controlling the heater using a first threshold value and a temperature detected by the temperature sensor when the judging step has judged that the recording sheet is not passing, and controlling the heater using a second threshold value, which is different from the first threshold value, and the temperature detected by the temperature sensor when the judging step has judged that the recording sheet is passing.

Note that the recording sheet is a medium on which an image is formed by the image forming device, and is a medium in the shape of a sheet, such as a sheet of paper or a sheet for OHP (Over-Head Projector).

With the above-stated structure, the image forming device of the present invention includes one temperature sensor that can detect the temperatures of both the recording sheet and one of rotation members, performs the temperature adjustment control based on the first threshold value and temperature of the rotation member when the temperature sensor is detecting the temperature of the rotation member; and performs the temperature adjustment control based on the second threshold value and temperature of the recording sheet when the temperature sensor is detecting the temperature of the recording sheet. Therefore, the first threshold value may be set to a standard temperature at which an excellent fixing can be obtained, based on the temperature of the rotation member preliminarily, and the second threshold value may be set to a standard temperature at which an excellent fixing can be obtained, based on the temperature of the recording sheet preliminarily. This enables the image forming device to perform the temperature adjustment control carefully in detail during the image forming operation such that it can obtain an excellent fixing regardless of whether the temperature sensor is detecting the temperature of the recording sheet or the temperature of one rotation member.

In the above-stated image forming device, when the judging part has judged that the recording sheet is not passing and a signal value output from the temperature sensor is equal to or higher than the first threshold value, the controller controls the heater so that heating performed by the heater is restricted, when the judging part has judged that the recording sheet is not passing and when the signal value output from the temperature sensor is lower than the first threshold value, the controller controls the heater so that heating performed by the heater is accelerated, when the judging part has judged that the recording sheet is passing and the signal value output from the temperature sensor is equal to or higher than the second threshold value, the controller controls the heater so that heating performed by the heater is restricted, and when the judging part has judged that the recording sheet is passing and the signal value output from the temperature sensor is lower than the second threshold value, the controller controls the heater so that heating performed by the heater is accelerated.

In the above-stated image forming method, when the judging step has judged that the recording sheet is not passing, the controlling step controls the heater so that heating performed by the heater is restricted when a signal value output from the temperature sensor is equal to or higher than the first threshold value, and controls the heater so that heating performed by the heater is accelerated when the signal value output from the temperature sensor is lower than the first threshold value, and when the judging step has judged that the recording sheet is passing, the controlling step controls the heater so that heating performed by the heater is restricted when the signal value output from the temperature sensor is equal to or higher than the second threshold value, and controls the heater so that heating performed by the heater is accelerated when the signal value output from the temperature sensor is lower than the second threshold value.

The above-described structure enables the image forming device to perform a control to decrease the temperature of one rotation member when the detected temperature is higher than the standard temperature at which an excellent fixing can be obtained, and to increase the temperature of one rotation member when the detected temperature is lower than the standard temperature, so that it can obtain an excellent fixing regardless of whether the temperature sensor is detecting the temperature of the recording sheet or the temperature of one rotation member. This enables the image forming device to control the heater with high accuracy during the image forming operation.

The above-stated image forming device may further comprise an error determination part that is, when the judging part has judged that the recording sheet is passing, operable to determine an occurrence of an error (i) when the signal value output from the temperature sensor is equal to or higher than a predetermined upper-limit value that is higher than the second threshold value, even after the heater is controlled so that the heating is restricted, or (ii) when the signal value is equal to or higher than a predetermined lower-limit value that is lower than the second threshold value even after the heater is controlled so that the heating is accelerated.

There is a high possibility that some trouble has occurred to the heater or the like when the temperature of the recording sheet continues to rise even after the heating by the heater is restricted, or when the temperature of the recording sheet continues to fall even after the heating by the heater is accelerated. In such a case, with the above-described structure, the image forming device can determine that an error has occurred. For this purpose, an upper-limit temperature and a lower-limit temperature, which are not reached in the normal state, may be determined by a measuring experiment and set preliminarily.

In the above-stated image forming device, the temperature sensor may be non-contact infrared sensor, and the image forming device may further comprise: a storage storing a first conversion table and a second conversion table, the first conversion table being used to convert an output voltage of the non-contact infrared sensor into a temperature value based on a heat radiation rate of the one of the pair of rotation members, the second conversion table being used to convert the output voltage of the non-contact infrared sensor into a temperature value based on a heat radiation rate of the recording sheet, wherein when the judging part has judged that the recording sheet is not passing, the controller controls the heater based on the temperature value converted via the first conversion table from the output voltage of the non-contact infrared sensor, and based on a temperature value corresponding to the first threshold value, and when the judging part has judged that the recording sheet is passing, the controller controls the heater based on the temperature value converted via the second conversion table from the output voltage of the non-contact infrared sensor, and based on a temperature value corresponding to the second threshold value.

In the above-stated image forming method, the temperature sensor may be a non-contact infrared sensor, and the image forming device further includes: a storage storing a first conversion table and a second conversion table, the first conversion table being used to convert an output voltage of the non-contact infrared sensor into a temperature value based on a heat radiation rate of the one of the pair of rotation members, the second conversion table being used to convert the output voltage of the non-contact infrared sensor into a temperature value based on a heat radiation rate of the recording sheet, wherein when the judging step has judged that the recording sheet is not passing, the controlling step controls the heater based on the temperature value converted via the first conversion table from the output voltage of the non-contact infrared sensor, and based on a temperature value corresponding to the first threshold value, and when the judging step has judged that the recording sheet is passing, the controlling step controls the heater based on the temperature value converted via the second conversion table from the output voltage of the non-contact infrared sensor, and based on a temperature value corresponding to the second threshold value.

The temperature sensor may be a device that outputs a signal whose value changes depending on the radiation rate of the heat radiator, such as a non-contact infrared sensor. In that case, with the above-described structure, it is possible to convert the signal values output from the temperature sensor into temperatures by using different tables in correspondence with the respective radiation rates of the one rotation member and the recording sheet. With the structure where a table for the radiation rate of the one rotation member and a table for the radiation rate of the recording sheet are preliminarily stored, it is possible to obtain the temperatures of the one rotation member and the recording sheet with high accuracy, based on the signal values output from the temperature sensor. This enables the image forming device to control the heater with high accuracy during the image forming operation.

The above-stated image forming device may further comprise an error determination part operable to determine an occurrence of an error when a value of the signal value, that is output from the temperature sensor while the judging part is judging that the recording sheet is not passing, is different, by a predetermined value or more, from a value of the signal value that is output from the temperature sensor while the judging part is judging that the recording sheet is passing.

The above-stated image forming method may further comprise the step of determining an occurrence of an error when a value of the signal value, that is output from the temperature sensor while the judging step is judging that the recording sheet is not passing, is different, by a predetermined value or more, from a value of the signal value that is output from the temperature sensor while the judging step is judging that the recording sheet is passing.

When there is an extreme difference between the detected temperatures of the one rotation member and the recording sheet and a normal temperature adjustment cannot be continued, there is a high possibility that a disconnection or a failure of the temperature sensor has occurred. In such a case, with the above-described structure, the image forming device can determine that an error has occurred.

In the above-stated image forming device, the judging part may sequentially obtain the signal value output from the temperature sensor, and continues to judge that the recording sheet is not passing while a difference between a value recently obtained from the temperature sensor and a value previously obtained from the temperature sensor is within a first predetermined range of value, and after the difference exceeds the first predetermined range of value, the judging part continues to judge that the recording sheet is passing until the difference exceeds a second predetermined range of value.

In the above-stated image forming method, the judging step may sequentially obtain the signal value output from the temperature sensor, and continues to judge that the recording sheet is not passing while a difference between a value recently obtained from the temperature sensor and a value previously obtained from the temperature sensor is within a first predetermined range of value, and after the difference exceeds the first predetermined range of value, the judging step continues to judge that the recording sheet is passing until the difference exceeds a second predetermined range of value.

With the above-described structure, the image forming device can judge whether the temperature sensor is detecting the temperature of the one rotation member or the temperature of the recording sheet, namely, whether the recording sheet is passing between the one rotation member and the temperature sensor, by checking the change in the signal value output from the temperature sensor. That is to say, since the temperature of the recording sheet is far lower than that of the one rotation member, the signal value output from the temperature sensor drastically falls when the recording sheet passes the fixing nip and between the one rotation member and the temperature sensor, and drastically rise after the recording sheet passes there. The amounts of the changes may be measured through an experiment, and predetermined amounts may be determined and set based on the results of the experiment.

The above-stated image forming device may further comprise an error determination part operable to determine an occurrence of an error when the judging part continues, for more than a predetermined time period, to judge that the recording sheet is passing.

When the judging part continues, for more than a predetermined time period, to judge that the recording sheet is passing, it indicates that the recording sheet is passing between the one rotation member and the temperature sensor for more than the predetermined time period. When this happens, there is a possibility that some trouble such as a paper jam or paper curling has occurred. In that case, with the above-described structure, the image forming device can determine that an error has occurred. An experiment may be performed to measure a time period that is required for the recording sheet to normally pass between the one rotation member and the temperature sensor, and a time period longer than the measured time period may be determined and set.

In the above-stated image forming device, an image forming process may be started by the controller, and before the controller starts the image forming process and after a predetermined time period passes after the controller starts the image forming process, the judging part judges that the recording sheet is not passing, and during the predetermined time period after the controller starts the image forming process, the judging part judges that the recording sheet is passing.

In the above-stated image forming method, an image forming process may be started by the controlling step, and before the controlling step starts the image forming process and after a predetermined time period passes after the controlling step starts the image forming process, the judging step judges that the recording sheet is not passing, and during the predetermined time period after the controlling step starts the image forming process, the judging step judges that the recording sheet is passing.

With the above-described structure, the image forming device can judge whether the recording sheet is passing between the one rotation member and the temperature sensor, depending on whether the controller has started the image forming operation. That is to say, the recording sheet starts passing the fixing nip and between the one rotation member after a first predetermined time period passes after the controlling step starts the image forming process, and stops passing after a second predetermined time period further passes after the first predetermined time period passes. These first and second predetermined time periods may be determined based on results of a measuring experiment and set preliminarily.

In the above-stated image forming device, the recording sheet may be classified into a plurality of types, and the image forming device further comprises: a storage storing a plurality of threshold values in correspondence with the plurality of types of recording sheet, respectively; and a paper determining part operable to determine a type of the recording sheet when the judging part has judged that the recording sheet is passing, wherein the controller controls the heater by using, as the second threshold value, a threshold value corresponding to the type of the recording sheet determined by the paper determining part when the judging part has judged that the recording sheet is passing.

In the above-stated image forming method, the recording sheet may be classified into a plurality of types, and the image forming device further includes a storage storing a plurality of threshold values in correspondence with the plurality of types of recording sheet, respectively, the image forming method further comprising the step of determining a type of the recording sheet when the judging step has judged that the recording sheet is passing, wherein the controlling step controls the heater by using, as the second threshold value, a threshold value corresponding to the type of the recording sheet determined by the paper determining step when the judging step has judged that the recording sheet is passing.

With the above-described structure, even when the recording sheet is classified into a plurality of types, and when, for example, the optimum fixing temperature varies depending on the type, threshold values can be set respectively for the plurality of types, and the image forming device can control the heater using an optimum threshold value for each type of recording sheet.

In the above-stated image forming device, the judging part may sequentially obtain the signal value output from the temperature sensor, and continues to judge that the recording sheet is not passing while a difference between a value recently obtained from the temperature sensor and a value previously obtained from the temperature sensor is within a first predetermined range of value, and after the difference exceeds the first predetermined range of value, the judging part continues to judge that the recording sheet is passing until the difference exceeds a second predetermined range of value, and the paper determining part determines the type of the recording sheet based on an amount of change in the signal value output from the temperature sensor.

With the above-described structure, the image forming device can judge the type of the recording sheet by checking the change in the signal value output from the temperature sensor. This is based on the fact that the thickness, heat radiation rate and the like change for each type of the recording sheet, and it is reflected in the amount of change of the signal value output from the temperature sensor. The amount of change of the output signal value for each type of the recording sheet may be determined based on results of a measuring experiment and set preliminarily.

In the above-stated image forming device, images may be formed respectively on a first face and a second face of the recording sheet, the first face and the second face being headed in opposite directions, the image forming device further comprises: a storage storing two different threshold values that respectively correspond to the first face and the second face; and an image forming face judging part operable to, when the judging part has judged that the recording sheet is passing, further judge on which of the first face and the second face of the recording sheet an image is being formed, wherein the controller controls the heater by using, as the second threshold value, a threshold value corresponding to a result of the judgment made by the image forming face judging part when the judging part has judged that the recording sheet is passing.

In the above-stated image forming method, images may be formed respectively on a first face and a second face of the recording sheet, the first face and the second face being headed in opposite directions, the image forming device further includes a storage storing two different threshold values that respectively correspond to the first face and the second face, the image forming method further comprising the step of further judging, when the judging step has judged that the recording sheet is passing, on which of the first face and the second face of the recording sheet an image is being formed, wherein the controlling step controls the heater by using, as the second threshold value, a threshold value corresponding to a result of the judgment made by the image forming face judging step when the judging step has judged that the recording sheet is passing.

With the above-described structure, when the image forming device performs the double-face printing, it is possible to control the heater using threshold values that differ in correspondence with a case where an image is formed on the first face (front face) and a case where an image is formed on the second face (back face). That is to say, when images are formed on both faces of the recording sheet, the recording sheet passes the fixing nip once when an image is formed onto the first face, and then the recording sheet passes the fixing nip again when an image is formed onto the second face. And at this time, the paper has already been warmed. For this reason, the second threshold value to be used when an image is formed on the second face may be lower than the first threshold value to be used when an image is formed on the first face. The threshold values may be set by taking account of such conditions so that the heater is controlled using an optimum threshold value.

In the above-stated image forming device, the controller may sequentially control the heater using the second threshold value and the temperature detected by the temperature sensor while the judging part is judging that the recording sheet is passing, and the image forming device further comprises an error determination part operable to determine an occurrence of an error when the controller continues, for more than a predetermined time period, to control the heater using the second threshold value and the temperature detected by the temperature sensor.

In the above-stated image forming method, the controlling step may sequentially control the heater using the second threshold value and the temperature detected by the temperature sensor while the judging step is judging that the recording sheet is passing, and the image forming method further comprises the step of determining an occurrence of an error when the controlling step continues, for more than a predetermined time period, to control the heater using the second threshold value and the temperature detected by the temperature sensor.

When the controller continues, for more than the predetermined time period, to control the heater using the second threshold value and the temperature detected by the temperature sensor, it indicates that the recording sheet is passing between the one rotation member and the temperature sensor for more than the predetermined time period. When this happens, there is a possibility that some trouble such as a paper jam or paper curling has occurred. In that case, with the above-described structure, the image forming device can determine that an error has occurred. An experiment may be performed to measure a time period that is required for the recording sheet to normally pass between the one rotation member and the temperature sensor, and a time period longer than the measured time period may be determined and set.

INDUSTRIAL APPLICABILITY

The present invention is broadly applicable to image forming devices for achieving image formation by transporting a recording sheet with an unfixed image formed thereon to pass a fixing nip such that the unfixed image is thermally fixed onto the recording sheet at the fixing nip that has been formed between two rotation members being located closely to each other as a pair, at least one of the two rotation members having been heated by a heater.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming device for achieving image formation by transporting a recording sheet with an unfixed image formed thereon to pass a fixing nip so that thereby the unfixed image is thermally fixed onto the recording sheet, the fixing nip being formed between two rotation members located closely to each other as a pair, at least one of the two rotation members having been heated by a heater, the image forming device comprising:

a non-contact infrared sensor located at a position more downstream than the fixing nip in a recording sheet transport direction, and operable to detect a surface temperature of one of the rotation members which is located across a recording sheet transport route from the non-contact infrared sensor;

a judging part operable to judge whether or not the recording sheet after the fixing is passing between the non-contact infrared sensor and the one of the rotation members;

a controller operable to control the heater using a first threshold value and a temperature detected by the non-contact infrared sensor when the judging part has judged that the recording sheet is not passing, and to control the heater using a second threshold value, which is different from the first threshold value, and the temperature detected by the non-contact infrared sensor when the judging part has judged that the recording sheet is passing; and a storage storing a first conversion table and a second conversion table, the first conversion table being used to convert an output voltage of the non-contact infrared sensor into a temperature value based on a heat radiation rate of the one of the pair of rotation members, the second conversion table being used to convert the output voltage of the non-contact infrared sensor into a temperature value based on a heat radiation rate of the recording sheet, wherein when the judging part has judged that the recording sheet is not passing, the controller controls the heater based on the temperature value converted via the first conversion table from the output voltage of the non-contact infrared sensor, and based on a temperature value corresponding to the first threshold value, and when the judging part has judged that the recording sheet is passing, the controller controls the heater based on the temperature value converted via the second conversion table from the output voltage of the non-contact infrared sensor, and based on a temperature value corresponding to the second threshold value.

2. The image forming device of claim 1, wherein when the judging part has judged that the recording sheet is not passing and a signal value output from the non-contact infrared sensor is equal to or higher than the first threshold value, the controller controls the heater so that heating performed by the heater is restricted, when the judging part has judged that the recording sheet is not passing and when the signal value output from the non-contact infrared sensor is lower than the first threshold value, the controller controls the heater so that heating performed by the heater is accelerated, when the judging part has judged that the recording sheet is passing and the signal value output from the non-contact infrared sensor is equal to or higher than the second threshold value, the controller controls the heater so that heating performed by the heater is restricted, and when the judging part has judged that the recording sheet is passing and the signal value output from the non-contact infrared sensor is lower than the second threshold value, the controller controls the heater so that heating performed by the heater is accelerated.

3. The image forming device of claim 2 further comprising an error determination part that is, when the judging part has judged that the recording sheet is passing, operable to determine an occurrence of an error (i) when the signal value output from the non-contact infrared sensor is equal to or higher than a predetermined upper-limit value that is higher than the second threshold value, even after the heater is controlled so that the heating is restricted, or (ii) when the signal value is equal to or lower than a predetermined lower-limit value that is lower than the second threshold value even after the heater is controlled so that the heating is accelerated.

4. The image forming device of claim 1 further comprising an error determination part operable to determine an occurrence of an error when a value of the signal value, that is output from the non-contact infrared sensor while the judging part is judging that the recording sheet is not passing, is different, by a predetermined value or more, from a value of the signal value that is output from the non-contact infrared sensor while the judging part is judging that the recording sheet is passing.

5. The image forming device of claim 1, wherein an image forming process is started by the controller, and before the controller starts the image forming process and after a predetermined time period passes after the controller starts the image forming process, the judging part judges that the recording sheet is not passing, and during the predetermined time period after the controller starts the image forming process, the judging part judges that the recording sheet is passing.

6. The image forming device of claim 1, wherein the recording sheet is classified into a plurality of types, and the image forming device further comprises:

a storage storing a plurality of threshold values in correspondence with the plurality of types of recording sheet, respectively; and a paper determining part operable to determine a type of the recording sheet when the judging part has judged that the recording sheet is passing, wherein the controller controls the heater by using, as the second threshold value, a threshold value corresponding to the type of the recording sheet determined by the paper determining part when the judging part has judged that the recording sheet is passing.

7. The image forming device of claim 1, wherein images are formed respectively on a first face and a second face of the recording sheet, the first face and the second face being headed in opposite directions, the image forming device further comprises:

a storage storing two different threshold values that respectively correspond to the first face and the second face; and an image forming face judging part operable to, when the judging part has judged that the recording sheet is passing, further judge on which of the first face and the second face of the recording sheet an image is being formed, wherein the controller controls the heater by using, as the second threshold value, a threshold value corresponding to a result of the judgment made by the image forming face judging part when the judging part has judged that the recording sheet is passing.

8. The image forming device of claim 1, wherein the controller sequentially controls the heater using the second threshold value and the temperature detected by the non-contact infrared sensor while the judging part is judging that the recording sheet is passing, and the image forming device further comprises an error determination part operable to determine an occurrence of an error when the controller continues, for more than a predetermined time period, to control the heater using the second threshold value and the temperature detected by the non-contact infrared sensor.

9. An image forming device for achieving image formation by transporting a recording sheet with an unfixed image formed thereon to pass a fixing nip so that thereby the unfixed image is thermally fixed onto the recording sheet, the fixing nip being formed between two rotation members located closely to each other as a pair, at least one of the two rotation members having been heated by a heater, the image forming device comprising:

a temperature sensor located at a position more downstream than the fixing nip in a recording sheet transport direction, and operable to detect a surface temperature of one of the rotation members which is located across a recording sheet transport route from the temperature sensor;

a judging part operable to judge whether or not the recording sheet after the fixing is passing between the temperature sensor and the one of the rotation members; and a controller operable to control the heater using a first threshold value and a temperature detected by the temperature sensor when the judging part has judged that the recording sheet is not passing, and to control the heater using a second threshold value, which is different from the first threshold value, and the temperature detected by the temperature sensor when the judging part has judged that the recording sheet is passing, wherein the judging part sequentially obtains the signal value output from the temperature sensor, and continues to judge that the recording sheet is not passing while a difference between a value recently obtained from the temperature sensor and a value previously obtained from the temperature sensor is within a first predetermined range of value, and after the difference exceeds the first predetermined range of value, the judging part continues to judge that the recording sheet is passing until the difference exceeds a second predetermined range of value.

10. The image forming device of claim 9 further comprising an error determination part operable to determine an occurrence of an error when the judging part continues, for more than a predetermined time period, to judge that the recording sheet is passing.

11. An image forming device for achieving image formation by transporting a recording sheet with an unfixed image formed thereon to pass a fixing nip so that thereby the unfixed image is thermally fixed onto the recording sheet, the fixing nip being formed between two rotation members located closely to each other as a pair, at least one of the two rotation members having been heated by a heater, the image forming device comprising:

a temperature sensor located at a position more downstream than the fixing nip in a recording sheet transport direction, and operable to detect a surface temperature of one of the rotation members which is located across a recording sheet transport route from the temperature sensor;

a judging part operable to judge whether or not the recording sheet after the fixing is passing between the temperature sensor and the one of the rotation members; and a controller operable to control the heater using a first threshold value and a temperature detected by the temperature sensor when the judging part has judged that the recording sheet is not passing, and to control the heater using a second threshold value, which is different from the first threshold value, and the temperature detected by the temperature sensor when the judging part has judged that the recording sheet is passing, wherein the recording sheet is classified into a plurality of types, and the image forming device further comprises:

a storage storing a plurality of threshold values in correspondence with the plurality of types of recording sheet, respectively; and a paper determining part operable to determine a type of the recording sheet when the judging part has judged that the recording sheet is passing, wherein the controller controls the heater by using, as the second threshold value, a threshold value corresponding to the type of the recording sheet determined by the paper determining part when the judging part has judged that the recording sheet is passing, and wherein the judging part sequentially obtains the signal value output from the temperature sensor, and continues to judge that the recording sheet is not passing while a difference between a value recently obtained from the temperature sensor and a value previously obtained from the temperature sensor is within a first predetermined range of value, and after the difference exceeds the first predetermined range of value, the judging part continues to judge that the recording sheet is passing until the difference exceeds a second predetermined range of value, and the paper determining part determines the type of the recording sheet based on an amount of change in the signal value output from the temperature sensor.

12. An image forming method for use in an image forming device for achieving image formation by transporting a recording sheet with an unfixed image formed thereon to pass a fixing nip so that thereby the unfixed image is thermally fixed onto the recording sheet, the fixing nip being formed between two rotation members located closely to each other as a pair, at least one of the two rotation members having been heated by a heater, the image forming device including a non-contact infrared sensor that is located at a position more downstream than the fixing nip in a recording sheet transport direction, and is operable to detect a surface temperature of one of the rotation members which is located across a recording sheet transport route from the non-contact infrared sensor, the image forming method comprising the steps of:

judging whether or not the recording sheet after the fixing is passing between the non-contact infrared sensor and the one of the rotation members; and controlling the heater using a first threshold value and a temperature detected by the non-contact infrared sensor when the judging step has judged that the recording sheet is not passing, and controlling the heater using a second threshold value, which is different from the first threshold value, and the temperature detected by the non-contact infrared sensor when the judging step has judged that the recording sheet is passing, wherein the image forming device further includes, a storage storing a first conversion table and a second conversion table, the first conversion table being used to convert an output voltage of the non-contact infrared sensor into a temperature value based on a heat radiation rate of the one of the pair of rotation members, the second conversion table being used to convert the output voltage of the non-contact infrared sensor into a temperature value based on a heat radiation rate of the recording sheet, wherein when the judging step has judged that the recording sheet is not passing, the controlling step controls the heater based on the temperature value converted via the first conversion table from the output voltage of the non-contact infrared sensor, and based on a temperature value corresponding to the first threshold value, and when the judging step has judged that the recording sheet is passing, the controlling step controls the heater based on the temperature value converted via the second conversion table from the output voltage of the non-contact infrared sensor, and based on a temperature value corresponding to the second threshold value.

13. The image forming method of claim 12, wherein when the judging step has judged that the recording sheet is not passing, the controlling step controls the heater so that heating performed by the heater is restricted when a signal value output from the non-contact infrared sensor is equal to or higher than the first threshold value, and controls the heater so that heating performed by the heater is accelerated when the signal value output from the non-contact infrared sensor is lower than the first threshold value, and when the judging step has judged that the recording sheet is passing, the controlling step controls the heater so that heating performed by the heater is restricted when the signal value output from the non-contact infrared sensor is equal to or higher than the second threshold value, and controls the heater so that heating performed by the heater is accelerated when the signal value output from the non-contact infrared sensor is lower than the second threshold value.

14. The image forming method of claim 12 further comprising the step of determining an occurrence of an error when a value of the signal value, that is output from the non-contact infrared sensor while the judging step is judging that the recording sheet is not passing, is different, by a predetermined value or more, from a value of the signal value that is output from the non-contact infrared sensor while the judging step is judging that the recording sheet is passing.

15. The image forming method of claim 12, wherein an image forming process is started by the controlling step, and before the controlling step starts the image forming process and after a predetermined time period passes after the controlling step starts the image forming process, the judging step judges that the recording sheet is not passing, and during the predetermined time period after the controlling step starts the image forming process, the judging step judges that the recording sheet is passing.

16. The image forming method of claim 12, wherein the recording sheet is classified into a plurality of types, and the image forming device further includes a storage storing a plurality of threshold values in correspondence with the plurality of types of recording sheet, respectively, the image forming method further comprising the step of determining a type of the recording sheet when the judging step has judged that the recording sheet is passing, wherein the controlling step controls the heater by using, as the second threshold value, a threshold value corresponding to the type of the recording sheet determined by the paper determining step when the judging step has judged that the recording sheet is passing.

17. The image forming method of claim 12, wherein images are formed respectively on a first face and a second face of the recording sheet, the first face and the second face being headed in opposite directions, the image forming device further includes a storage storing two different threshold values that respectively correspond to the first face and the second face, the image forming method further comprising the step of further judging, when the judging step has judged that the recording sheet is passing, on which of the first face and the second face of the recording sheet an image is being formed, wherein the controlling step controls the heater by using, as the second threshold value, a threshold value corresponding to a result of the judgment made by the image forming face judging step when the judging step has judged that the recording sheet is passing.

18. The image forming method of claim 12, wherein the controlling step sequentially controls the heater using the second threshold value and the temperature detected by the non-contact infrared sensor while the judging step is judging that the recording sheet is passing, and the image forming method further comprises the step of determining an occurrence of an error when the controlling step continues, for more than a predetermined time period, to control the heater using the second threshold value and the temperature detected by the non-contact infrared sensor.

19. An image forming method for use in an image forming device for achieving image formation by transporting a recording sheet with an unfixed image formed thereon to pass a fixing nip so that thereby the unfixed image is thermally fixed onto the recording sheet, the fixing nip being formed between two rotation members located closely to each other as a pair, at least one of the two rotation members having been heated by a heater, the image forming device including a temperature sensor that is located at a position more downstream than the fixing nip in a recording sheet transport direction, and is operable to detect a surface temperature of one of the rotation members which is located across a recording sheet transport route from the temperature sensor, the image forming method comprising the steps of:

judging whether or not the recording sheet after the fixing is passing between the temperature sensor and the one of the rotation members; and controlling the heater using a first threshold value and a temperature detected by the temperature sensor when the judging step has judged that the recording sheet is not passing, and controlling the heater using a second threshold value, which is different from the first threshold value, and the temperature detected by the temperature sensor when the judging step has judged that the recording sheet is passing, wherein, the judging step sequentially obtains the signal value output from the temperature sensor, and continues to judge that the recording sheet is not passing while a difference between a value recently obtained from the temperature sensor and a value previously obtained from the temperature sensor is within a first predetermined range of value, and after the difference exceeds the first predetermined range of value, the judging step continues to judge that the recording sheet is passing until the difference exceeds a second predetermined range of value.

* * * * *